US006637313B1

(12) United States Patent
Kerr

(10) Patent No.: US 6,637,313 B1
(45) Date of Patent: Oct. 28, 2003

(54) ROTARY PUMP

(75) Inventor: John Hugh Kerr, Kingston (CA)

(73) Assignee: Ker-Train Holdings Ltd., Kingston (CA)

( * ) Notice: Subject to any disclaimer, the term of this patent is extended or adjusted under 35 U.S.C. 154(b) by 0 days.

(21) Appl. No.: 09/807,010

(22) PCT Filed: Oct. 7, 1999

(86) PCT No.: PCT/CA99/00921

§ 371 (c)(1),
(2), (4) Date: Jun. 11, 2001

(87) PCT Pub. No.: WO00/20760

PCT Pub. Date: Apr. 13, 2000

(51) Int. Cl.[7] ..... F01B 1/06
(52) U.S. Cl. ..... 92/72; 91/491
(58) Field of Search ..... 92/72; 91/491; 417/273

(56) References Cited

U.S. PATENT DOCUMENTS 2,217,796 A * 10/1940 Dell ..... 417/273
2,612,110 A * 9/1952 Delegard ..... 417/204
4,578,948 A * 4/1986 Hutson et al. ..... 417/204

* cited by examiner

*Primary Examiner*—Edward K. Look
*Assistant Examiner*—Michael Leslie
(74) *Attorney, Agent, or Firm*—Clark Hill PLC

(57) ABSTRACT

A rotary pump consists of a cam ring, a rotor disposed within the cam ring, and a pump body enclosing the cam ring and the rotor. The cam ring includes a cam surface having a centre of symmetry. The rotor has a centre of rotation which coincides with the centre of symmetry of the cam surface, and includes a plurality of fluid chambers. Each fluid chamber comprises an aperture opening into a circumference of the rotor, and a pump element sealingly disposed within the aperture. As the rotor revolves, each element remains in contact with the cam surface and moves over a stroke length between a first position adjacent the radial innermost portion of the respective aperture and a second position adjacent the radial outermost portion of the respective aperture. The pump body includes a fluid inlet and a fluid outlet respectively for transferring fluid to and fluid from the fluid chambers as the rotor rotates. Preferably, the pump also includes an actuator for rotating the cam ring about its centre of symmetry between a first angular position and a second angular position for varying the stroke length of the pump elements.

10 Claims, 18 Drawing Sheets

100
102
104
106
106a
106b
108
110
112
114
116,118
116a
116b
118a
118b
x
y
x'
y'
-x'
-y'
45°
90°
180°
0°
+0.5
0.0
-0.5
1.0
0.5
2.0
+.055
-.055
V
S
P

Fig.3a
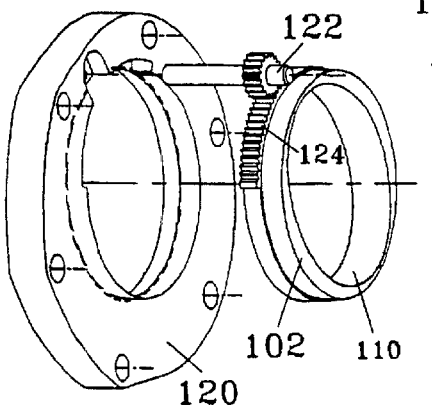
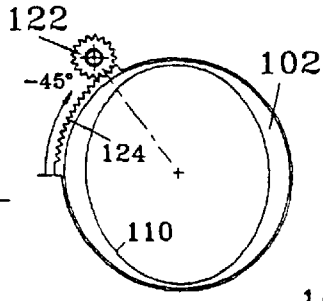
Fig.3b
Fig.3c
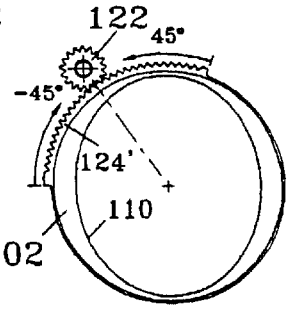
Fig.3d
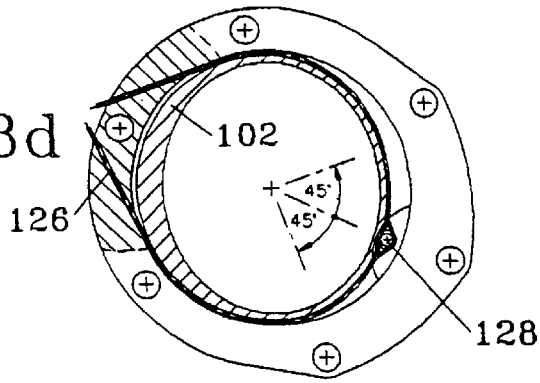
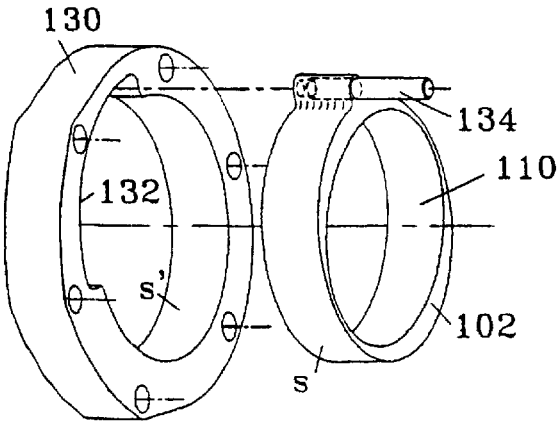
Fig.3e
Fig.3f
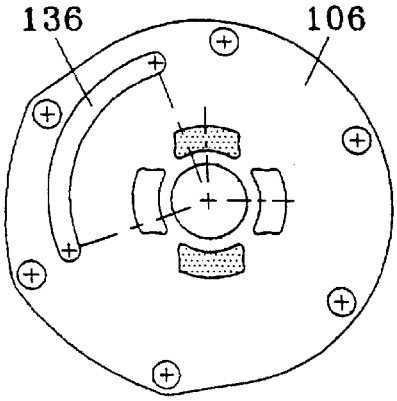

200
202
206
206a
206b
210
104
108
114
216
216a
216b
216c
218
218a
218b
218c
30°
60°
r1
r2
x'
-x'
y'
-y'
+0.5
0.0
-0.5
1.0
0.5
0.0
S
P
+.037
-.037
3.0
0°
60°
120°

Fig.8a
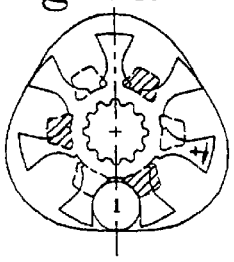
Fig.8b
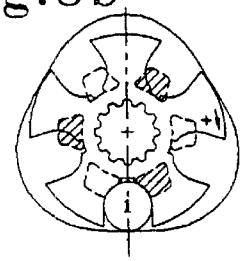
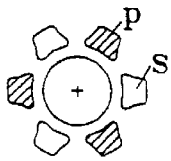
Fig.8c
Fig.10a
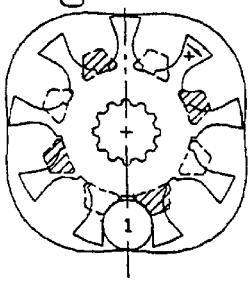
Fig.10b
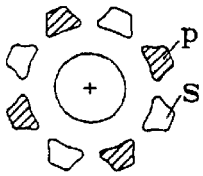
Fig.9a
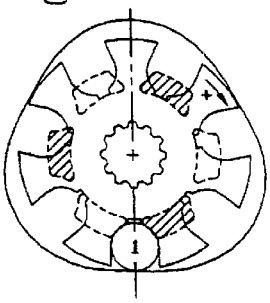
Fig.9b
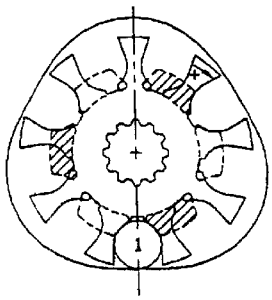
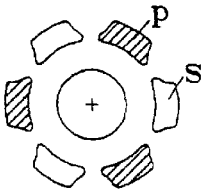
Fig.9c
Fig.12a
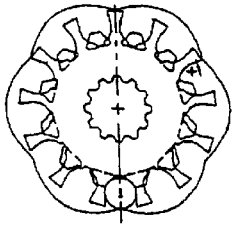
Fig.11a
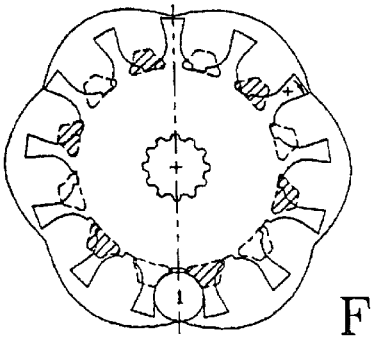
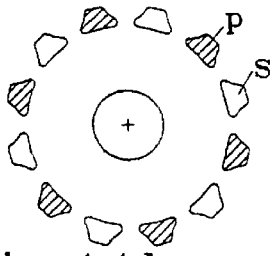
Fig.11b
Fig.12b
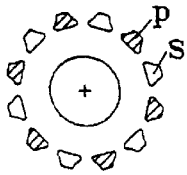

376b
380
386
306b
330
306a
378
376a
P
S
108
384
300

336
318b
372
316b
382
318a
316a
370
306

336
cb
382'
376

336
384
318b
370
318a
378

336
372
316b
386
316a
380

800

1000
1002
1004
1006a
1006b
1008
1010
1012
1014
1016
1018
1050
1052
1072
1075a
1075b
1076a
1076b
i
e

ROTARY PUMP

FIELD OF THE INVENTION

The present invention relates to a rotary hydraulic device. In particular, the present invention relates to a hydraulic pump or motor including a rotor carrying a number of piston elements around its periphery, and a cam ring enclosing the rotor for causing the piston elements to move along a stroke length as the rotor rotates.

BACKGROUND OF THE INVENTION

Many industrial and automotive devices require a continuous supply of fluid, such as oil, fuel or hydraulic fluid, for proper operation. However, it is also desirable to be able to maintain or vary the delivery rate of the fluid as the application demands. To meet this need, two approaches have been taken:

1. a constant-capacity pump is driven by a prime mover, and the flow rate of the pump is varied by returning a portion of fluid from the output port of the pump back to the input port
2. a variable-capacity pump, including a fluid delivery piston, is driven by a prime mover, and the flow rate of the pump is altered by altering the stroke of the piston The former approach makes inefficient use of the energy used to drive the pump since a portion of pressurized fluid is returned to the reservoir instead of performing useful work. On the other hand, the latter approach has been favoured because (1) variable-capacity pumps make more efficient use of energy, (2) the speed of the prime mover can vary without impacting on the flow rate of the variable-capacity pump, and (3) variable capacity pumps can alter their output flow rate more rapidly, in response to changes in operating conditions, than constant-capacity pumps.

The conventional variable-flow rotary pump comprises a hollow casing; a cam ring provided within the casing; and a rotor provided within the cam ring and being rotatably mounted about a fixed axis. The rotor includes a series of radial angularly-spaced fluid chambers disposed about its circumference, and a roller provided within each slot. The casing includes a fluid inlet port for delivering fluid to the fluid chambers, and a fluid outlet port for receiving pressurized fluid from the fluid chambers. Generally, the centre axis of the cam ring is displaced a distance from the fixed axis of the rotor. Consequently, as the rotor rotates, the volume of each fluid chamber will vary between minimum and maximum values as the respective roller moves between its innermost position and its outermost position. Further, the cam ring includes means for varying the position of the cam ring relative to the rotor. In one position, the centre of the cam ring is displaced a maximum distance from the fixed axis of the rotor, causing the communication time a fluid chamber of increasing volume is in communication with the inlet port to be maximized. In another position, the centre of the cam ring is displaced a minimum distance from the fixed axis of the rotor, causing the communication time a fluid chamber of increasing volume is in communication with the inlet port to be minimized. Consequently, the output flow rate of the pump can be varied between a maximum and a minimum value without varying the rotational speed of the rotor.

Numerous variations on the conventional variable-flow rotary pump have been developed. For instance, Wilcox (U.S. Pat. No. 3,381,622) teaches a variable-flow rotary pump having a constant output pressure. As shown in FIG. 1 of the patent, the pump comprises a mounting plate 20; a cavity body 30 mounted to the mounting plate 20; a cavity ring 31 provided within the cavity body 30; and a rotor 32 rotatably mounted about a fixed axis within the cavity ring 31. The rotor 32 includes a series of radial angularly-spaced slots 33, each including a pump roller 34. The mounting plate 20 includes an arcuate fluid inlet port 62 and an arcuate fluid outlet port 63 aligned with the root circle of the roller slots 33 for respectively delivering fluid to and removing fluid from each slot 33 as the rotor 32 rotates. The pump also includes a leaf spring 110, and a pressure conduit 91 coupled between the cavity ring 31 and the leaf spring 110 for reducing the eccentricity of the cavity ring (and hence the output pressure) as output pressure increases.

Bristow (U.S. Pat. No. 4,679,995) teaches avariable-flow rotary pump which is substantially similar to the variable-flow rotary pump taught by Wilcox, except that the cam ring 10 (equivalent to the cavity ring 31) is rotatably coupled at one end and to a transversely-extending spring 23 at the opposite end for urging the cam ring 10 into a maximum pump flow position. At the same time, a portion of the pressurized output fluid exerts a force opposite to the force exerted by the spring 23 so as to reduce the output flow of the pump when the output pressure increases.

Maistreli (U.S. Pat. No. 3,642,388) teaches a variable-capacity vane pump whose output flow is continuously variable. As shown in FIG. 2 of the patent, the vane pump comprises a hollow casing 1 including an inlet port 24 and an outlet port 25; a cam ring 9 provided within the casing 1; and a rotor 2 rotatably mounted about a fixed axis within the cam ring 9. The rotor 2 includes a series of radial angularly-spaced notches 6 each including a cylindrical roller. The cam ring 9 is rotatably coupled to a roller 41 at one end, and to a hydraulically-operated piston 11 at the opposite end for urging the ring 9 between a maximum pump flow position and a minimum pump flow position in response to changes in hydraulic fluid pressure delivered to the piston 11.

Hutson (U.S. Pat. No. 4,578,948) teaches a reversible-flow vane pump. As shown in FIGS. 3,4 and 5 of the patent, the pump comprises a pump case (not shown) including a first 76 and a second 78; an annular cam ring 40 provided within the pump case and being pivotable about a pin 44; and a rotor 20 rotatably mounted about a fixed axis within the cam ring 40. The rotor 20 includes a series of equally-spaced circumferential outwardly-opening slots 32, each including a roller vane 34 which engages the inner cam surface of the annular cam ring 40.

In the operating mode shown in FIG. 4 of the patent, the cam ring 40 is pivoted about pin 44 so as to increase the communication time a fluid chamber of increasing volume is in communication with the first port 76 and thereby cause a forward pump flow between ports 76 and 78, whereas in the operating mode shown in FIG. 5, the cam ring 40 is pivoted in an opposite direction about pin 44 so as to increase the communication time a fluid chamber of increasing volume is in communication with the s econd port 78 and thereby cause a reverse flow between ports 76 and 78 without reversing the direction of rotation of the rotor 20. In the operating mode shown in FIG. 3, the cam ring 40 is positioned so that the communication times of the fluid chambers in communication with the first port 76 is equal to the communication times of fluid chambers in communication with the second port 78. Consequently, in this latter position, there is no net fluid flow between the ports 76, 78.

Delegard (U.S. Pat. No. 2,612,110) describes a variable flow rotary pump which comprises an oval cam ring, a rotor disposed within the cam ring and having a number of pockets each retaining a piston therein, and end plates having fluid inlet and outlet ports in communication with the outermost portion of the pockets.

Grupen (U.S. Pat. No. 2,880,677) describes a variable volume vane pump which includes a stator provided with a symmetric oval through-bore, diametrically-opposed inlet ports and diametrically-opposed outlet ports opening into the bore via the radially outermost portion of the bore, and a set of uniformly-spaced slots opening into the periphery of the rotor each carrying a sliding vane which projects into the bore.

Each of the foregoing variations has addressed deficiencies of the conventional variable-flow rotary pump. However, in each variation, differences in the fluid pressures of the fluid chamber approaching the outlet port and the fluid chamber leaving the outlet port can cause unwanted ripples in the output pressure of the pump.

Attempts have also been made to control the output pressure of a rotary pump. Brighton (European Patent 0 841 485) describes a self-regulating rotary pump which includes an outer spacer ring, a flexible cam ring disposed within the spacer ring, a cavity disposed between the spacer ring and the cam ring, a rotor disposed within the cam ring and carrying a number of slots carrying pistons therein, and end plates having fluid outlet ports and fluid inlet ports aligned with the radially innermost portion of the slots. The cam ring includes a pair of apertures for bleeding pressurized fluid into the cavity regions and thereby deform the cam ring between a symmetric oval configuration and a circular configuration in response to variations in average output pressure.

Sipe (European Patent 0 200 294) discloses a rotary pump configured for reducing pressure pulsations in the discharge flow. The pump comprises a cam ring having an oval high displacement cam surface, and a rotor having a number of radially-extending slots each receiving a cylindrical vane member. Each slot includes a driving surface which has a surface portion which is configured to reduce the pressure pulsations by maintaining the roller vanes in contact with the cam surface.

Although both Brighton and Sipe attempt to reduce variations in output pressure, neither Brighton would not be able to reduce fluid cavitation, and the driving surface disclosed by Sipe would be difficult to manufacture. Accordingly, there remains a need for a rotary pump which provides a steady fluid output pressure and reduces the likelihood of fluid cavitation.

SUMMARY OF THE INVENTION

According to the present invention, there is provided a rotary pump which addresses the deficiency of the prior art.

The rotary pump, according to the present invention, comprises a cam ring, a rotor disposed within the cam ring, and a pump body enclosing the cam ring and the rotor. The cam ring includes a cam surface having a centre of symmetry. The rotor has a centre of rotation which coincides with the centre of symmetry of the cam surface, and includes a plurality of fluid chambers. Each fluid chamber comprises an aperture opening into a circumference of the rotor, and a pump element sealingly disposed within the aperture. As the rotor revolves, each element remains in contact with the cam surface and moves over a stroke length between a first position adjacent the radial innermost portion of the respective aperture and a second position adjacent the radial outermost portion of the respective aperture. The pump body includes a fluid inlet and a fluid outlet respectively for transferring fluid to and fluid from the fluid chambers as the rotor rotates. Preferably, the pump also includes an actuator for rotating the cam ring about its centre of symmetry between a first angular position and a second angular position for varying the stroke length of the pump elements.

In one embodiment of the invention, the cam surface comprises a number "N" (at least two) of cam lobes. The pump body includes an equal number of fluid inlets and fluid outlets, with the number of fluid inlets and the number of fluid outlets corresponding to the number "N" of cam lobes.

In another embodiment of the invention, the pump body includes an equal number "N" (at least two) of fluid inlets and fluid outlets, and the cam surface is shaped so that each pump element cycles over the stroke length "N" times per rotor revolution.

BRIEF DESCRIPTION OF THE DRAWINGS

The preferred embodiments of the invention will now be described, by way of example only, with reference to the drawings, in which:

FIGS. 3*a*–3*f* depict two stroke actuators for varying the angular position of the cam profile of the two-stroke pump shown in FIG. 1;

FIGS. 8*a*–8*c*, 9*a*–9*c*, 10*a*–10*b*, 11*a*–11*b*, and 12*a*–12*b* demonstrate design parameters which impact on port size for the rotary pumps of the invention;

DETAILED DESCRIPTION OF THE PREFERRED EMBODIMENTS

Figures 1A, 1B, 1C, 1D, 1E, 2A, 2B, 2C:
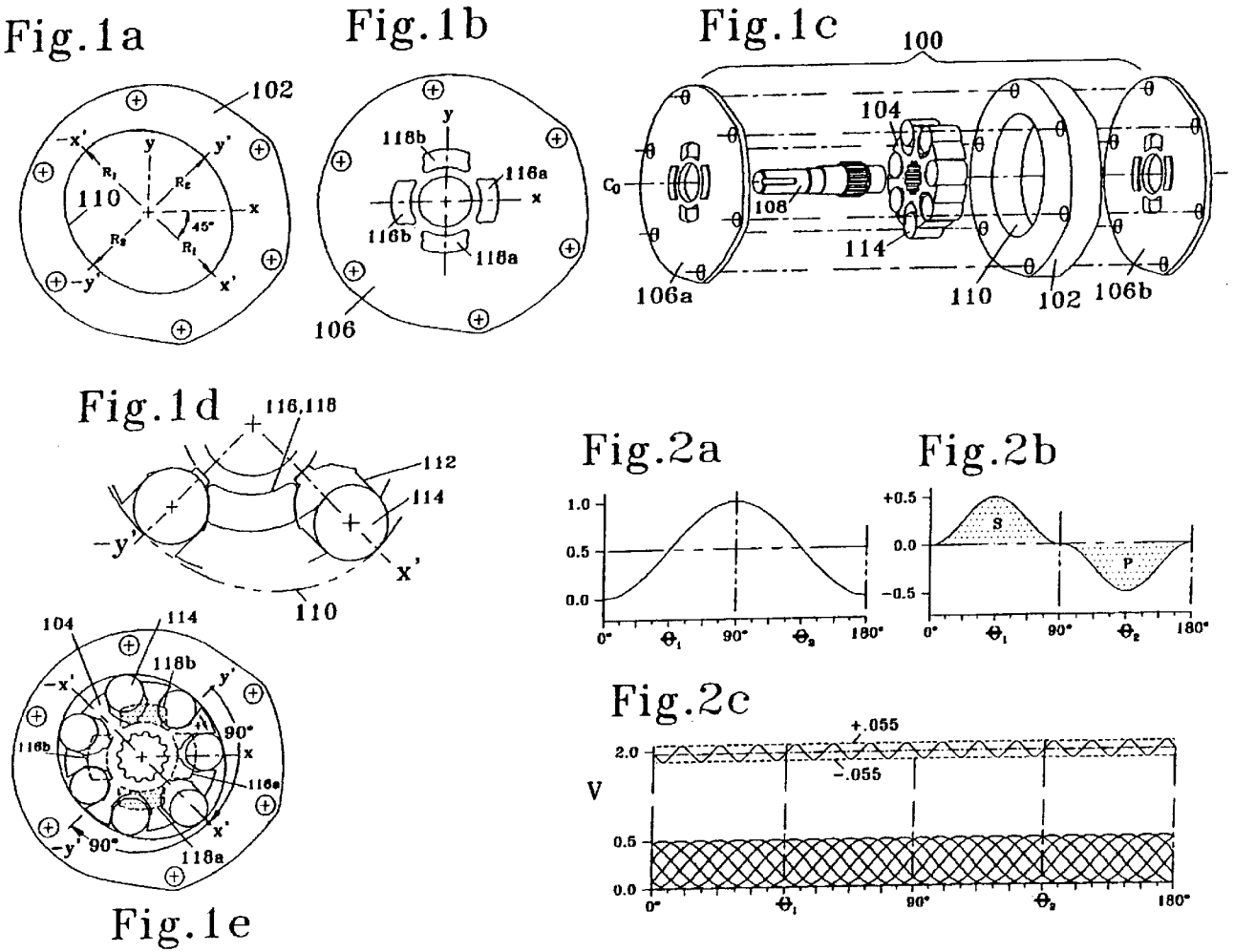
FIGS. 1*a*–1*e* depict a two stroke pump according to the present invention, showing the cam ring with its cam profile, the rotor disposed within the cam ring, and the piston elements provided within the periphery of the rotor.
FIGS. 2*a*–2*c* are graphs of operating characteristics of the pump shown in FIG. 1.

Turning to FIG. 1, a rotary pump, denoted generally as 100, is shown comprising a two stroke cam ring 102, a rotor 104 disposed within the cam ring 102, a pair of end plates 106*a*, 106*b* enclosing the cam ring 102 and the rotor 104, and a rotatable shaft 108 including splines for rotating the rotor 104. The pump 100 also includes an actuator (not shown) for varying the output flow-rate of the pump 100. However, it should be understood that the actuator is not an essential feature of the invention, and may be dispensed with where only a constant flow rate pump is desired.

The cam ring 102 includes a cam surface 110 having a centre of symmetry coinciding with the axis of rotation of the rotor 104. In the embodiment shown in FIG. 1, the cam surface 110 is shaped as an ellipse with major and minor radii R1, R2 at 90 degree intervals. However, as will become apparent, the invention is not limited to cam rings having elliptical cam surfaces, but includes any multi-lobe shape having a centre of symmetry.

The rotor 104 includes a plurality of fluid chambers provided around the circumference of the rotor 104. Each fluid chamber comprises an aperture 112 opening into the circumference of the rotor 104, and a pump element 114 sealingly disposed within each aperture 112. Each aperture 112 has a substantially U-shape, and a cavity extending radially inwards from the radial innermost portion of the U-shaped portion. The width of each U-shaped portion is slightly greater than the width of each pump element 114 so as to allow each pump element 114 to move within the respective aperture 112 between a fully seated position adjacent the radial innermost portion of the aperture 112 and a filly extended position adjacent the radial outermost portion of the aperture 112 as the rotor 104 rotates. The distance between these two positions will be referred to as the stroke length.

Each end plate 106 includes a pair of diametrically opposed arcuately-shaped suction ports 116*a*, 116*b* and a pair of diametrically opposed arcuately-shaped pressure ports 118*a*, 118*b*. With reference to an X-Y coordinate system in which the X-axis passes through the suction ports 116 and the Y-axis passes through the pressure ports 118, the major axis X' of the elliptical cam surface 110 is shown rotated by an angle of 45 from the ports 116, 118. Each of the ports 116, 118 has an inner radial portion which coincides with the radial innermost portion of the apertures 112, an outer radial portion which overlaps with the inner radial surface of those pump elements 114 oriented and their fully seated position, and end portions extending between the radial inner and outer portions which mirror the shape of the U-shaped portion of the apertures 112.

In operation, the rotatable shaft 108 rotates the rotor 104 about an axis coinciding with the centre of symmetry of the cam surface 110. As the rotor 104 rotates, the pump elements 114 remain in contact with the cam surface 110. However, as the cam surface 10 shown in FIG. 1 has an elliptical shape, each of the pump elements 114 move within their respective apertures 112 over the stroke length between the fully seated position and the fully extended position. As a result, fluid is drawn into the fluid chambers through the suction ports 116 as the pump elements 114 move from their fully seated position to their fully extended position, and is then expelled from the fluid chambers through the pressure ports 118 as the pump elements 114 move from their fully extended position to their fully seated position. Since the cam surface 110 is shaped as an ellipse and, therefore has two cam lobes, each pump element 114 cycles over the stroke length twice for each revolution of the rotor 104.

FIGS. 2*a*, 2*b* and 2*c* show respectively the relative position of each pump element 114 within the respective aperture 112, suction volume S and discharge volume P, and the accumulated phased discharges of a rotor having seven pump elements 114 over a 180 degree of rotation of the rotor 104. As shown in FIG. 2*c*, the amplitude of output ripple is between 5.5% of total discharge, which is about half that of a single stroke pump.

FIG. 3*a* depicts an actuator suitable for use with the pump 100 shown in FIG. 1. As shown, the actuator comprises a body plate 120 enclosing the cam ring 102, and a pinion 122 rotatably coupled to the body plate 120. The outer radial surface of the cam ring 102 includes a splined sector 124 for engaging the pinion 122. Alternately, the body plate 120 may include a plurality of pinions 122. As will be appreciated, rotation of the pinion 122 causes the cam ring 102, and the cam surface 110, to rotate about the centre of symmetry of the cam surface 110. By doing so, the communication time which a fluid chamber of increasing volume remains in communication with one of the suction ports 116, and the communication time which a fluid chamber of decreasing volume remains in communication with one of the pressure ports 118 will vary, causing the output flow rate of the pump 100 to vary accordingly.

FIG. 3*b* depicts a variation of the actuator shown in FIG. 3*a*, capable of rotating the cam surface 110 between 0 and −45°. FIG. 3*c* depicts another variation of the actuator shown in FIG. 3*a*, capable of rotating the cam surface 110 between +45 and −45°

FIG. 3*d* depicts a variation of the actuator shown in FIG. 3*a*, comprising a body plate 120' enclosing the cam ring 102, a recirculating cable 126 trained around the cam ring 102, and a pin 128 for securing recirculating cable 126 to the cam ring 102. FIGS. 3*e* and 3*f* depict another variation of the actuator shown in FIG. 3*a*, comprising a body plate 130 provided with an arcuate sector cut-out 132. The cam ring 102 includes a control rod 134 attached to the outer radial surface of the cam ring 102, and one of the end plates 106 includes an arcuate cut-out 136 corresponding to the arcuate sector cut-out 132 of the body plate 130. The control rod 134 slides radially within the arcuate sector cut-out 132 and the arcuate cut-out 136 so as to rotate the cam ring 102, and the cam surface 110, about the centre of symmetry of the cam surface 110.

Figure 4:
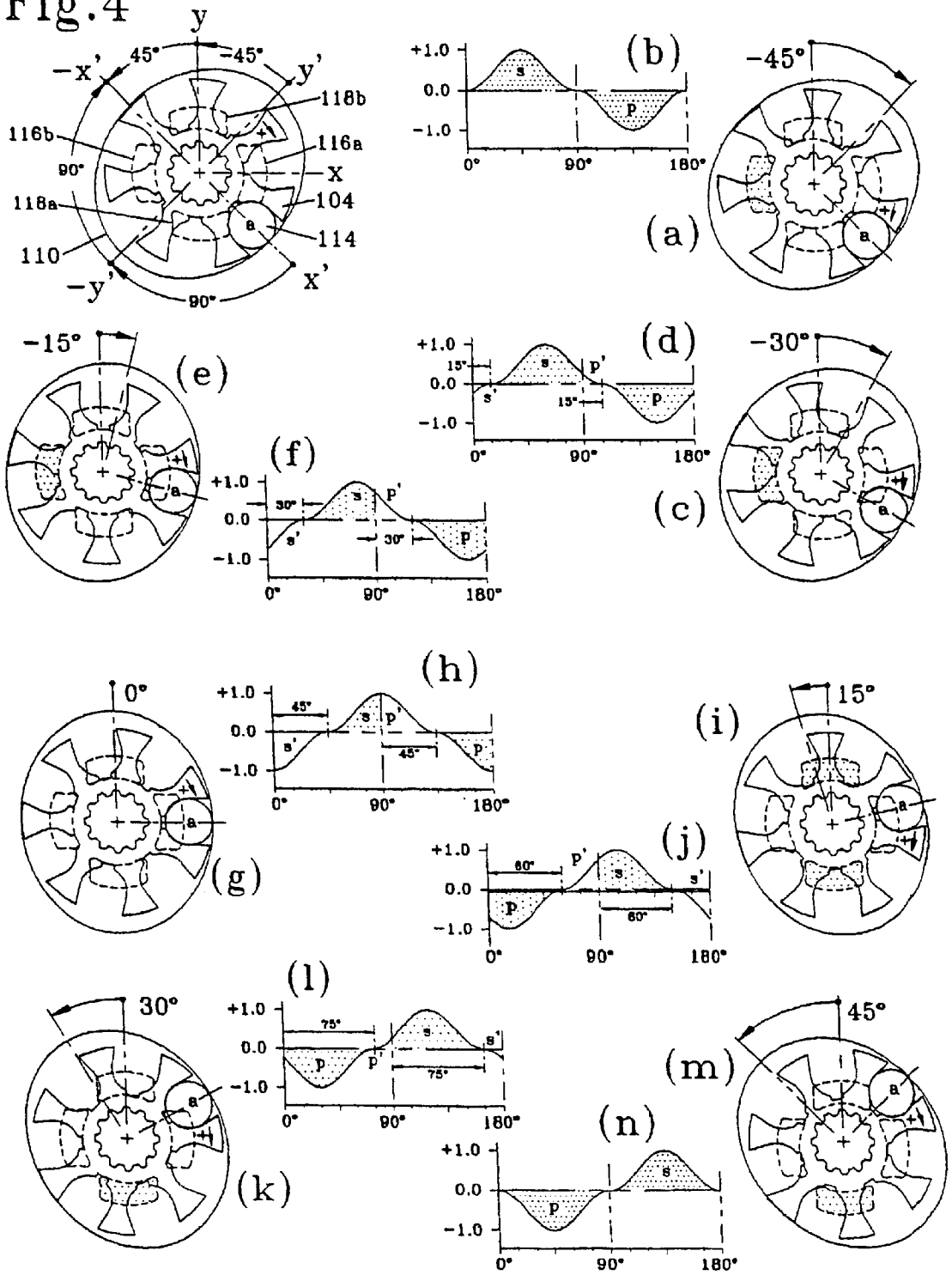
FIGS. 4*a*–4*n* are graphs of operating characteristics of the pump as the angular position of the cam profile is varied.

FIG. 4 shows graphs of suction S and discharge for 180° of rotation of the rotor 104, over 15 degree increments of cam surface 110 rotation between −45° and +45° relative to the X-Y coordinate system referred to above. FIGS. 4*a*, 4*b* show that for cam surface 110 rotation of −45°, suction S end discharge P are respectively confined to ports 118*a* and 116*b*. FIGS. 4*c*, 4*d* show that for cam surface 110 rotation of −30°, suction S and discharge P respectively overlap ports 116*a*, 118*a* and ports 118*a*, 116*b* for 15° of a normal 90 degree period. Port overlapping induces a panting phenomenon which lessens the discharge from each fluid chamber and the discharge P from the pump 100, thereby providing an effective means to vary fluid displacement.

FIGS. 4*e*, 4*f* show that for cam surface 110 rotation of −15°, the induced panting phenomenon extends over a 30 degree period, and consequently that the discharge from each fluid chamber and the discharge P from pump 100 is reduced further. FIGS. 4*g*, 4*h* show that for cam surface 110 rotation of 0°, the induced panting phenomenon extends over a 45° period, thereby effectively reducing the discharge from each fluid chamber and the discharge P from pump 100 to zero.

FIGS. 4*i*, 4*j* show that for cam surface 110 rotation of +15°, the induced painting phenomenon is re-established for a 30 degree period. However, the bias in favour of ports 116*a* and 116*b* during the period of port 116*a*, 118*a* and 118*a*, 116*b* overlap, effectively reverses the function of ports. FIGS. 4*k*, 4*l* show that for cam surface 110 rotation of +30°, overlap decreases to 15°, while FIGS. 4*m*, 4*n* show that for cam surface 110 rotation of +45°, overlap drops to 0°. In the latter case, the induced panting phenomenon is no longer present, and a complete reversal of port function takes place.

Turning to FIG. 5, a rotary rate pump, denoted generally as 200, a shown comprising the three stroke cam ring 202, a rotor 104 disposed within the cam ring 202, a pair of end plates 206*a*, 206*b* enclosing the cam ring 202 and the rotor 104, and a rotatable shaft 108 including splines for rotating the rotor 104. The pump 200 also includes an actuator (not shown) for varying the output flow-rate of the pump 200. The cam ring 202 includes a cam surface 210 having a centre of symmetry coinciding with the axis of rotation of the rotor 104 and a modified three lobed epicycloidal profile with major and minor radii R1, R2 at 60 degree intervals.

Each end plate 206 includes three equally spaced arcuately shaped suction ports 216 interposed with three equally spaced arcuately shaped pressure ports 218. As above, each of the ports 216, 218 has an inner radius which coincides with the radial innermost portion of the apertures 112, and an outer radius which overlaps with the inner radial surface of those pump elements 114 oriented and their fully seated position. However, the span-wise arc length of the ports 216, 218 is less than one-third that of the ports 116, 118 of the pump 100. Further, with reference to an X-Y coordinate system in which the X-axis passes through a suction port 216 and a diametrically opposed pressure port 218, the major axis X' of the cam surface 210 is shown rotated by an angle of 30° from the ports 216, 218.

In operation, the rotatable shaft 108 rotates the rotor 104 about an axis coinciding with the centre of symmetry of the cam surface 210. As the rotor 104 rotates, the pump elements 114 remain in contact with the cam surface 210. However, as the cam surface 210 shown in FIG. 3 has a three lobed epicycloid profile, each of the pump elements 114 move within their respective apertures 112 over the stroke length between the fully seated position and the fully extended position. As a result, fluid is drawn into the fluid chambers through the suction ports 216 as the pump elements 114 move from their fully seated position to their fully extended position, and is then expelled from the fluid chambers through the pressure ports 218 as the pump elements 114 move from their fully extended position to their fully seated position. Since the cam surface 210 has three cam lobes, each pump element 114 cycles over the stroke length three times for each revolution of the rotor 104.

Figures 5A, 5B, 5C, 5D, 6A, 6B, 6C:
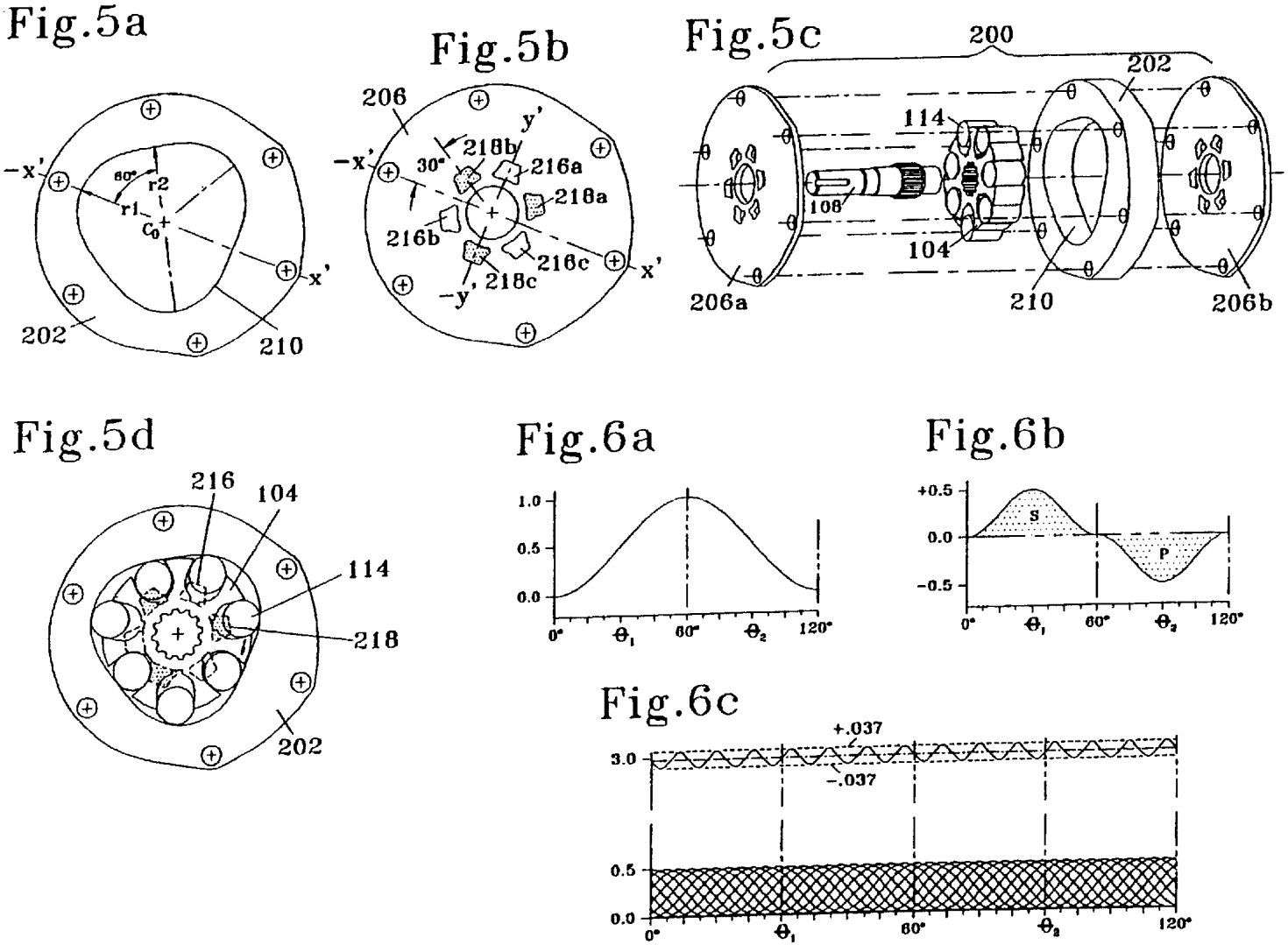
FIGS. 5*a*–5*d* depict a three stroke pump according to the present invention, showing the cam ring with its cam profile, the rotor disposed within the cam ring, and the piston elements provided within the periphery of the rotor.
FIGS. 6*a*–6*c* are graphs of operating characteristics of the pump shown in FIG. 5.

FIGS. 6*a*, 6*b* and 6*c* show respectively the relative position of each pump element 114 within the respective aperture 112, suction volume S and discharge volume P, and the accumulated phased discharges of a rotor having seven pump elements 114 over a 120 degree of rotation of the rotor 104. As shown in FIG. 2*c*, the amplitude of output ripple is between 3.7% of total discharge, which is about one third that of a single stroke pump.

Figure 7A:
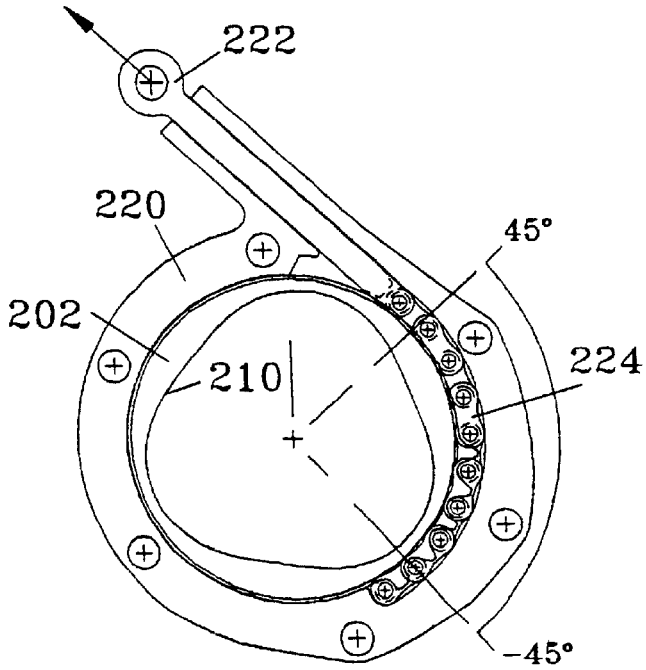
FIGS. 7*a*–7*c* depict two three actuators for varying the angular position of the cam profile of the three-stroke pump shown in FIG. 5.
Figure 7B:
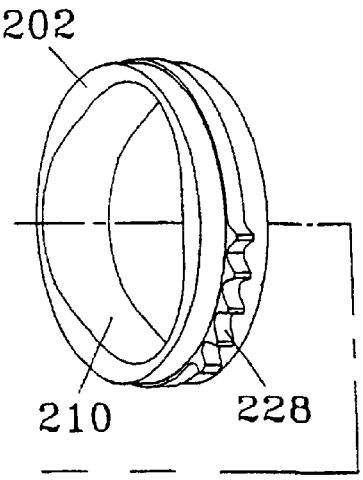
Figure 7C:
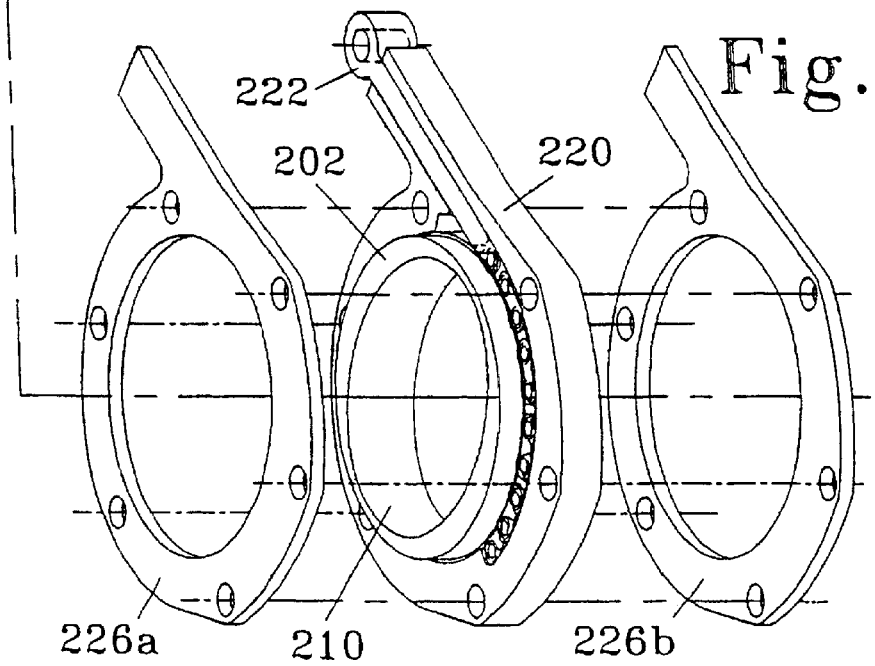

FIG. 7 depicts an actuator suitable for use with the pump 200 shown in FIG. 4. As shown, the actuator comprises a body plate 220 enclosing the cam ring 202, a push-pull lever 222 slidably coupled to the body plate 220, a silent chain section 224 attached to the push-pull lever 222, and a pair of side plates 226*a*, 226*b* guiding the push-pull lever 222 and the silent chain section 224 within the body plate 220. The outer radial surface of the cam ring 202 includes a sprocket sector 228 for engaging the chain section 224. Inward or outward movement of the push-pull lever 222 causes the cam ring 202, and the cam surface 210, to rotate about the centre of symmetry of the cam surface 210. By doing so, the communication time which a fluid chamber of increasing volume remains in communication with one of the suction ports 216, and the communication time which a fluid chamber of decreasing volume remains in communication with one of the pressure ports 218 will vary, causing the output flow rate of the pump 200 to vary accordingly.

As will be appreciated, any of the actuators shown in FIGS. 3 and 5 may be used with the pumps 100, 200. Also, if the graphs of FIGS. 4*b*, 4*d*, 4*f*, 4*h*, 4*j*, 4*l* and 4*n* were based on 120° of rotor rotation, instead of 180°, and depicted 10 degree increments of cam surface rotation, instead of 15°, those figures would accurately represent the characteristics of the three stroke cam surface 210 shown in FIG. 5. Therefore, it will be apparent from the foregoing discussion that in the general case where the cam surface includes "N" lobes, with "N" being an integer greater than or equal to two, the angular separation over which the cam surface may be rotated is 360°/2N.

Turning now to FIGS. 8 to 12, the design criteria which affect cavitation will be explained. As is well known to those of ordinary skill, cavitation is an induced flow disturbance caused by a choking action on fluid flow, and is a concern in rotating disc pumps or motors with ports on rotor end plates. This phenomenon is affected by the ratio of port size to the swept volume of a fluid chamber during an intake stroke of a pump element. FIG. 8*a* shows the end plate 206 for a three stroke cam ring 202 for use in conjunction with a rotor 104 having seven fluid chambers, while FIG. 8b shows the end plate 206 for a three stroke cam ring 202 for use in conjunction with the rotor 104 having five fluid chambers of equivalent size. FIG. 8*c* depicts the ports 216, 218 for both end plate 206 and rotor 104 configurations, indicating that the number of fluid chambers in the rotor has no effect on the size of the ports.

FIG. 9*a* shows the end plate 206 for a three stroke cam ring 202 for use in conjunction with a rotor 104 having seven fluid chambers, while FIG. 9*b* shows the end plate 206 for a tree stroke cam ring for use in conjunction with a rotor 104 having nine fluid chambers of the same size as those shown in FIG. 9*a* but provided on a larger sized rotor 104. FIG. 9*c* depicts the ports 216, 218 for both end plate 206 and rotor 104 configurations, indicating that although the number of fluid chambers in a rotor has no effect on port size, an increase in the outer diameter of the rotor 104 will increase port size.

FIG. 10 shows the eight port end plate for a four stroke cam ring for use in conjunction with a rotor of equivalent size to that shown in FIG. 9*a*, indicating that port size decreases if the number of strokes per cycle is increased without a corresponding increase in rotor size. FIG. 11 shows the end plate for a six stroke cam ring for use in conjunction with a rotor having twelve fluid chambers of the same size as those shown in FIG. 9*a*, whereas FIG. 12 shows the end plate for a six stroke cam ring for use in conjunction with a rotor having thirteen fluid chambers of half the size as those shown in FIG. 9*a*, indicating again that an increase in the number of strokes per cycle without a corresponding increase in rotor size will reduce port size. Consequently, it will be apparent that for a given swept-volume, port size is a function of the number of strokes per cycle and the diameter of the rotor, but is not a function of the number of fluid chambers in a rotor.

Figure 15:
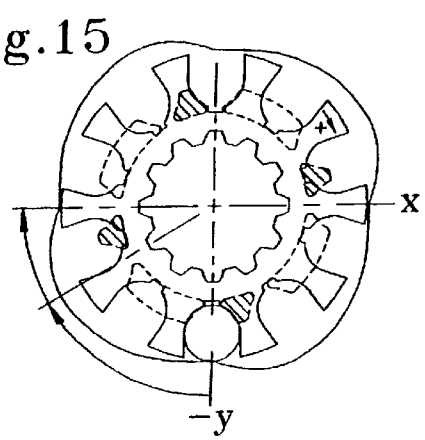
FIGS. 13 to 15 depict cam profiles for which the port inlets and outlets are of unequal sizes.
Figure 14:
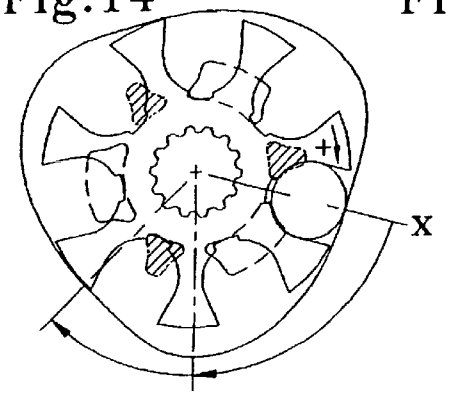
Figure 13:
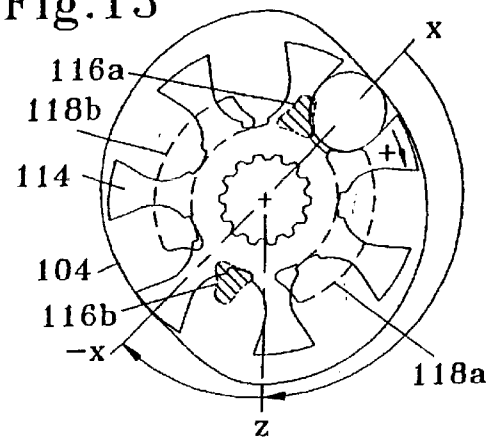

Thus far, each of the suction ports 116 and the pressure ports 118 shown have been of equal angular length. However, as FIGS. 13 to 15 demonstrate, the invention is not so limited FIG. 13 shows the asymmetric cam profile for a two-stroke cam surface 110 in which the suction ports 116 extend over a larger angular interval than the pressure ports 118. Similarly, FIGS. 14 and 15 respectively show the asymmetric cam profiles for a three-stroke cam surface 210 and a four-stroke cam surface in which the suction ports 116 extend over a larger angular interval than the pressure ports 118. In each of these cases, the increase in angular length of the suction ports increases the real time for fluid ingress, but may also expose fluid ingress to cavitation.

Figure 16:
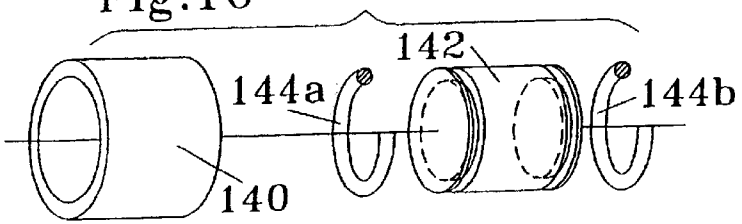

Turning now to FIG. 16, a pump element 114 suitable for use with the foregoing pump embodiments is shown comprising a tubular shell 140, and a solid core 142 retained within the tubular shell 140. O-ring seals 144*a*, 144*b* are provided at opposite ends of the core 142 thereby providing the shell 140 with a degree of diametric flexibility so that sealing between the pump element 114 and the respective aperture 112 is enhanced when the shell 140 is under diametric loading.

Figure 17:
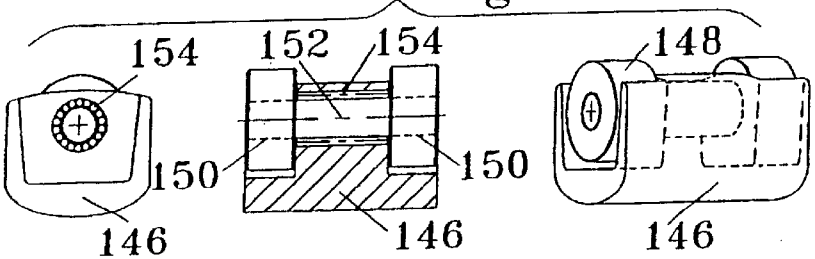

FIG. 17 depicts a variation of the pump element 114 shown in FIG. 16, comprising a U-shaped shell 146, and a spool-shaped core 148 provided within the shell 146. The core 148 includes a pair of disc-shaped ends 150 joined together via a centre shaft 152 extending between the disc-shaped ends 150. The pump element also includes a plurality of roller bearings 154 disposed between the centre shaft 152 and the inner U-shaped surface of the shell 146 to allow the disc-shaped ends 150 to function as followers with congruency to the cam surface.

Figure 18:
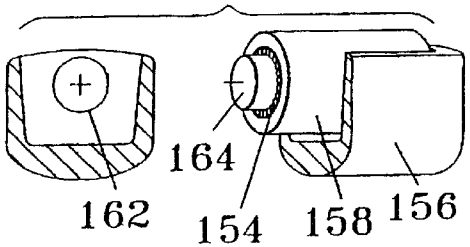
FIGS. 16 to 18 depict variations on the piston elements for the pumps according to the invention.

FIG. 18 depicts another variation of the pump element 114, comprising a U-shaped shell 156, and a cylindrical core 158 provided within the shell 156. The shell 156 includes a pair of closed opposite ends 160, and a bearing hole 162 provided within each opposite end 160. The core 158 includes an axially-extending mandrel 164 provided at each opposite end of the core 158 for insertion into the bearing holes 162 and thereby rotatably securing the core 158 to the shell 156. The pump element also includes a plurality of roller bearings disposed around each mandrel 164 to allow the core 158 to function as a follower with congruency to the cam surface. Other variations of the foregoing pump element configurations will be apparent to those skilled in the art.

Having described preferred embodiments for rotary pumps, according to the present invention, the following discussion will focus on applications of the described rotary pumps. FIG. 19 shows a hydraulic device 300 which can be used either as a pump or a motor. The hydraulic device 300 comprises a rotatable cam ring, a body plate 330 enclosing the cam ring for allowing the cam ring to rotate about the centre of symmetry of the respective cam surface, a rotor 104 disposed within the cam ring 302, front and rear rotor end plates 306*a*, 306*b* enclosing the rotor 304, a rotatable shaft 108 coupled to the rotor 104, and an actuator for rotating the cam surface about its centre of symmetry. Preferably, the cam ring, the body plate 330, and the actuator respectively comprise the cam ring 102, the body plate 130 and the actuator control rod 134 shown in FIGS. 3*e* and 3*f*. However, the hydraulic device 300 is not limited to the cam ring 102, the body plate 130 and the actuator control rod 134, but is intended to comprise any of the cam ring, body plate, and actuator variations described herein, including any variations equivalent thereto. Also, as discussed above, the actuator may be dispensed with if desired. The cam ring, the rotor 104 and the actuator are deleted from FIG. 19 for the purpose of clarity.

Figures 19A, 19B, 19C, 19D, 19E:
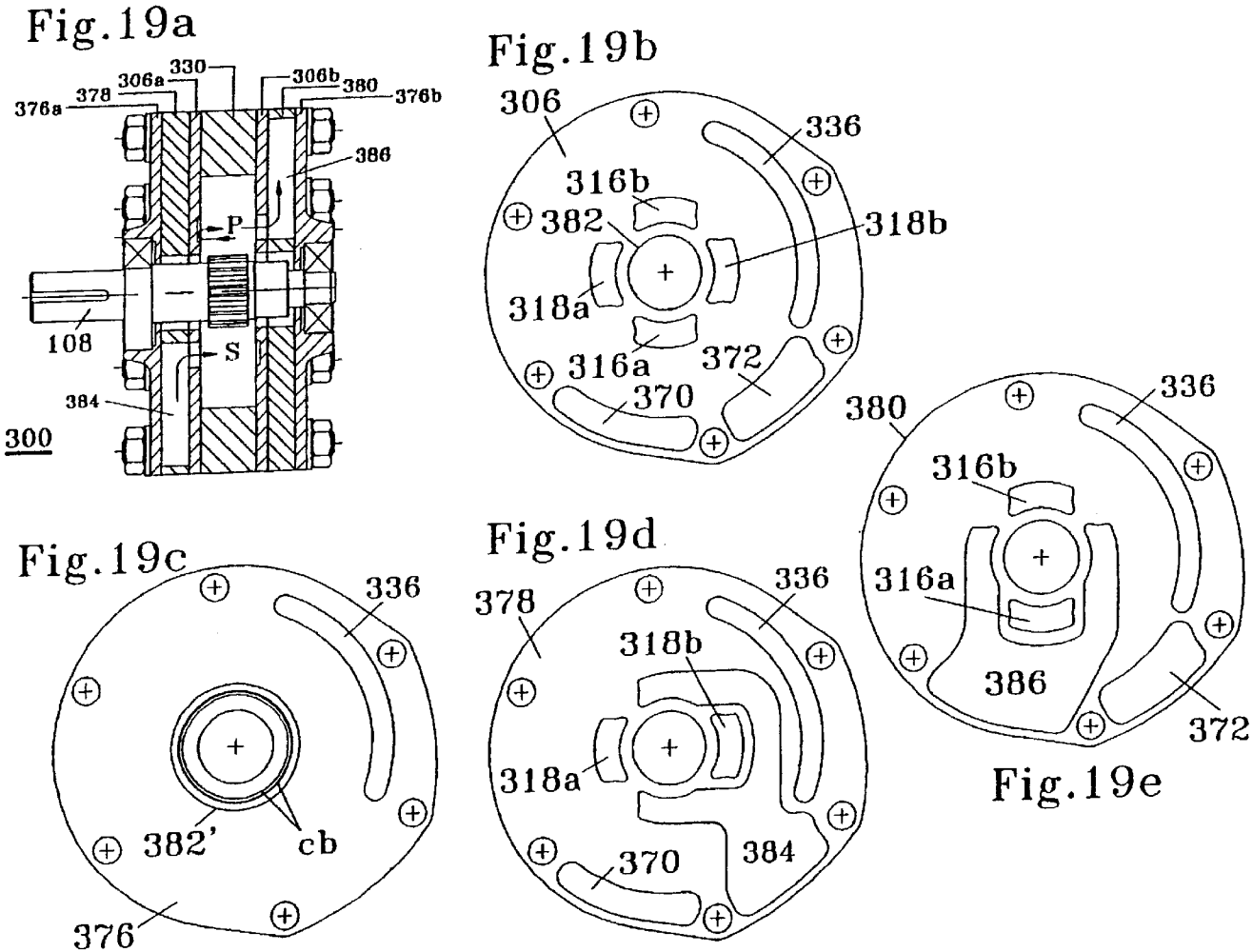
FIGS. 19*a*–19*e* depict a hydraulic device based on the pumps of the invention, suitable for use as pump or a motor.

The rotor end plates 306 are shown in FIG. 19*b*, and include a pair of diametrically opposed arcuately-shaped first ports 316*a*, 316*b* and a pair of diametrically opposed arcuately-shaped second ports 318*a*, 318*b*. The rotor end plates 306 also include first and second oil gallery ports 370, 372, an arcuate slot 336 adjacent the outer perimeter of the rotor end plates 306 for receiving the actuator control rod 134 therethrough, and a central aperture 382 for receiving the rotatable shaft 108 therethrough.

The hydraulic device 300 also includes front and rear casing end plates 376*a*, 376*b*, a front oil gallery plate 378 disposed between the front casing end plate 376*a* and the front rotor end plate 306*a*, and a rear oil gallery plate 380 disposed between the rear casing end plate 376*b* and the rear rotor end plate 306*b*. As shown in FIG. 19*c*, the casing end plates 376 include a central aperture 382 for receiving the rotatable shaft 108 therethrough, and an arcuate slot 336 adjacent the outer perimeter of the casing end plate 376 for receiving the actuator control rod 134.

The front oil gallery plate 378 is shown in FIG. 19*d*, and comprises the second ports 318*a*, 318*b*, the first oil gallery port 370, and a first oil gallery 384 communicating with both of the first ports 316*a*, 316*b* and the second oil gallery port 372. The rear oil gallery plate 380 is shown in FIG. 19*e*, and comprises the first ports 316*a*, 316*b*, the second oil gallery port 372, and a second oil gallery 386 communicating with both of the second ports 318*a*, 318*b* and the first oil gallery port 370.

When the hydraulic device 300 is operated as a pump, the rotatable shaft 108 rotates the rotor about the centre of symmetry of the cam surface, causing fluid to be drawn up from the first oil gallery 384 into the fluid chambers of the rotor through the first ports 316, and then to be expelled into the second oil gallery 386 through the second ports 318. When the hydraulic device 300 is operated as a motor, fluid is applied under pressure from the first oil gallery 384 into the fluid chambers of the rotor through the first ports 316, and is expelled into the second oil gallery 386 through the second ports 318, causing the rotating shaft 108 to rotate.

Figure 20:
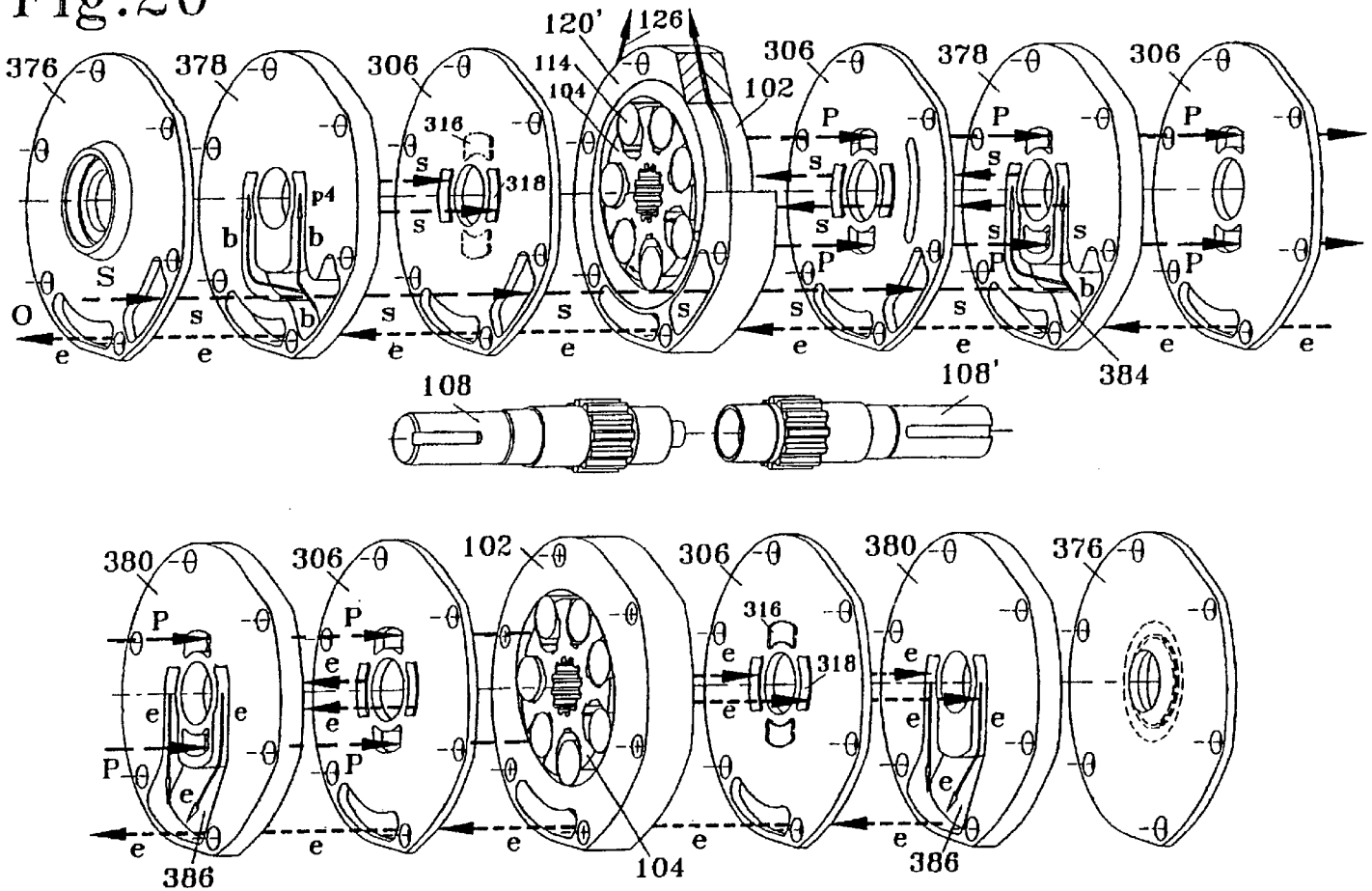
FIGS. 20–22 depict a hydrostatic transmission incorporating the hydraulic device shown in FIG. 19.

FIG. 20 depicts a hydrostatic transmission 400 comprising a first and second hydraulic devices 300*a*, 300*b*, substantially identical to the hydraulic device 300 shown in FIG. 19. However, unlike the hydraulic device 300, the first hydraulic device 300*a* operates as a pump, and includes an additional front oil gallery plate 378 in replacement of the rear oil gallery plate 380. The second hydraulic device 300*b* operates as a motor, and includes an additional rear oil gallery plate 380 in replacement of the front oil gallery plate 378. Also, the front oil gallery plates 378 are modified such that the first oil gallery 384 communicates with both of the second ports 318*a*, 318*b* instead of the first ports 316*a*, 316*b*. Further, the first hydraulic device 300*a* is provided with the actuator described above with reference to FIG. 3*d*, comprising the body plate 120' enclosing the cam ring 102, and the recirculating cable 126 trained around the cam ring 102. However, it should be understood that other actuators may be used without departing from the scope of the invention.

The first and second hydraulic devices 300*a*, 300*b* are then coupled together through a common rotor end plate 306 provided between the front oil gallery plate 378 of the first hydraulic device 300*a* and the rear oil gallery plate 380 of the second hydraulic device 300*b*. With this arrangement, the first ports 316 of the first hydraulic device 300*a* communicate with the first ports 316 of the second hydraulic device 300*b*, and second ports 318 of the second hydraulic device 300*b* communicate with the second ports 318 of the first hydraulic device 300*a*.

In operation, rotation of the input shaft 108 of the first hydraulic device 300*a* rotates the respective rotor about the centre of symmetry of the cam surface, causing fluid to be drawn up from the first oil galleries 384 into the fluid chambers of the rotor of the first hydraulic device 300*a* through the second ports 318, and then to be expelled out under pressure through the first ports 316. The pressurized expelled fluid is fed into the fluid chambers of the rotor of the second hydraulic device 300*b* through the first ports 316 thereof, causing the rotor and the output shaft 108' of the second hydraulic device 300*b* to rotate. While the latter rotor rotates, fluid is expelled from the fluid chambers thereof into the second oil galleries 386 through the pressure ports 318.

As will be appreciated, by rotating the cam surface of the cam ring 102 through the actuator, the output flow rate of the first hydraulic device 300*a* will vary, causing the rotational speed of the rotatable shaft 108 of the second hydraulic device 300*b* to vary accordingly. As will be apparent from the discussion of FIG. 4, the output shaft 108' rotates in the same direction as the input shaft 108, and varies from zero to full rotational speed when the angle of rotation of the cam profile of the first hydraulic device 300*a* is limited to 90°. The output shaft 108' will rotate in the same or the opposite direction as the input shaft 108, and will vary from zero to full rotational speed when the angle of rotation of the cam profile of the first hydraulic device 300*a* is extended to 180°.

Figure 21:
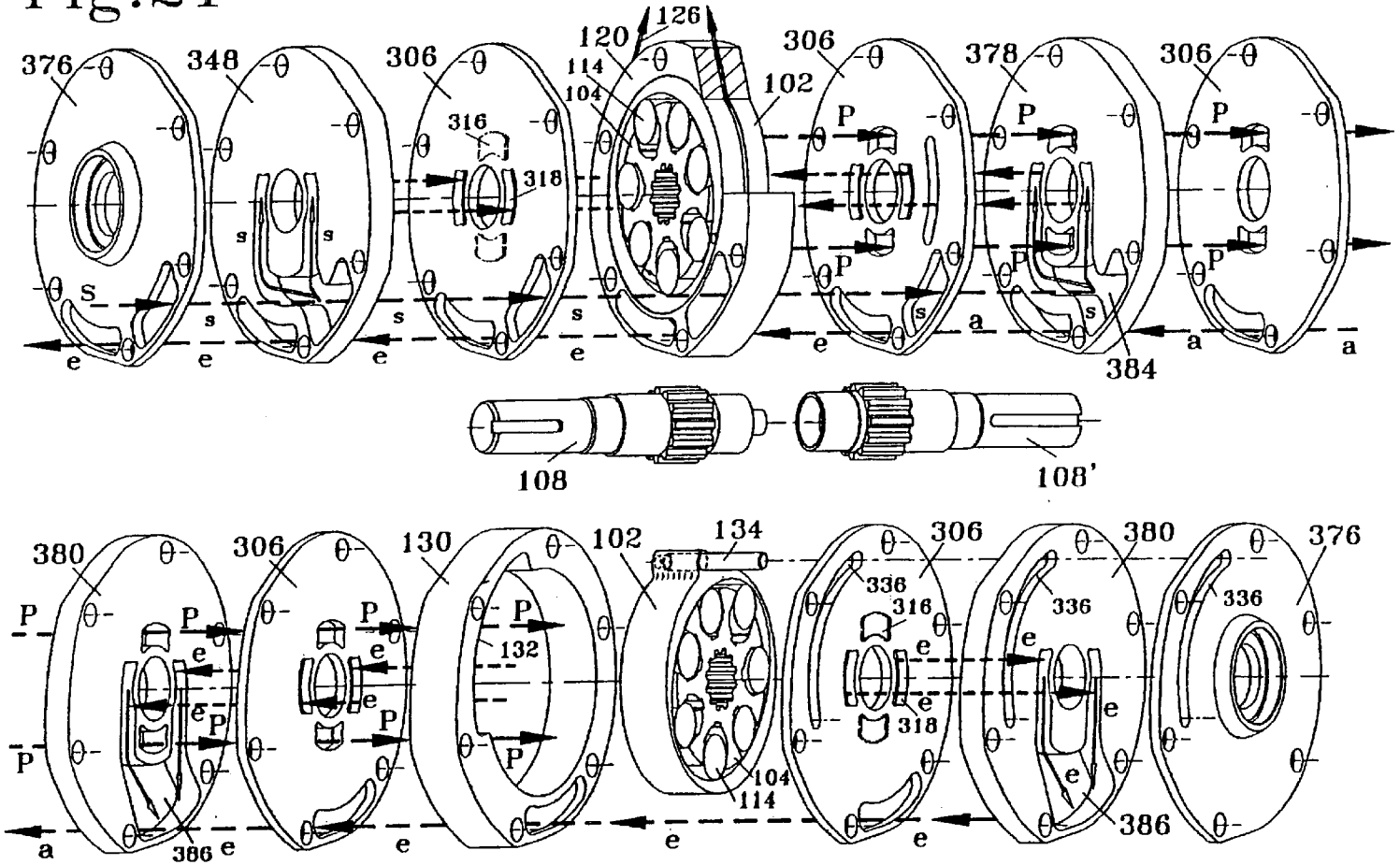
Figure 22:
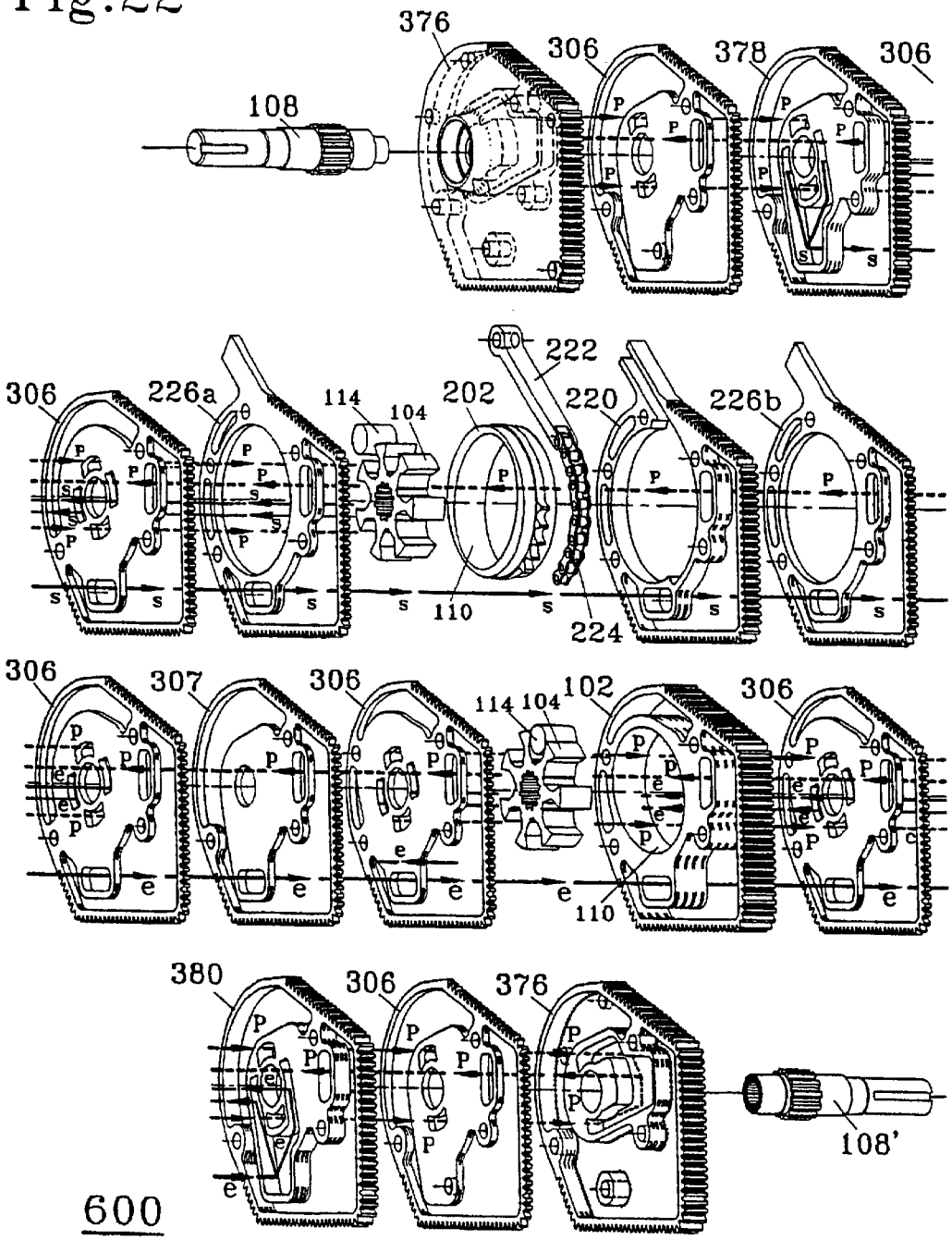

Numerous variations of the hydrostatic transmission 400 may be realized. For instance, FIG. 21 depicts a hydrostatic transmission 500, substantially similar to the hydrostatic transmission 400, except that the second hydraulic device 300*b* is provided with the actuator described above with reference to FIG. 3*e*, comprising the body plate 130 provided with the arcuate sector cut-out 132, and the control rod 134 attached to the outer radial surface of the cam ring 102. In this embodiment, the output shaft 108' will rotate in the same or the opposite direction as the input shaft 108, and will vary from zero to full rotational speed even if the angle of rotation of the cam profile of the first hydraulic device 300*a* is limited to 90°. FIG. 22 depicts a hydrostatic transmission 600, again substantially similar to the hydrostatic transmission 400, except that the hydraulic devices 300*a*, 300*b* include cooling fins, and the second hydraulic device 300*b* is provided with the actuator described above with reference to FIG. 7, comprising the body plate 220 enclosing the cam ring 202, the push-pull lever 222 slidably coupled to the body plate 220, and a silent chain section 224 attached to the push-pull lever 222. As above, the output shaft 108' rotates in the same direction as the input shaft 108, and varies from zero to full rotational speed when the angle of rotation of the cam profile of the first hydraulic device 300*a* is limited to 90°, but will rotate in the same or the opposite direction as the input shaft 108, and will vary from zero to full rotational speed when the angle of rotation of the cam profile of the first hydraulic device 300*a* is extended to 180°.

Figure 23B:
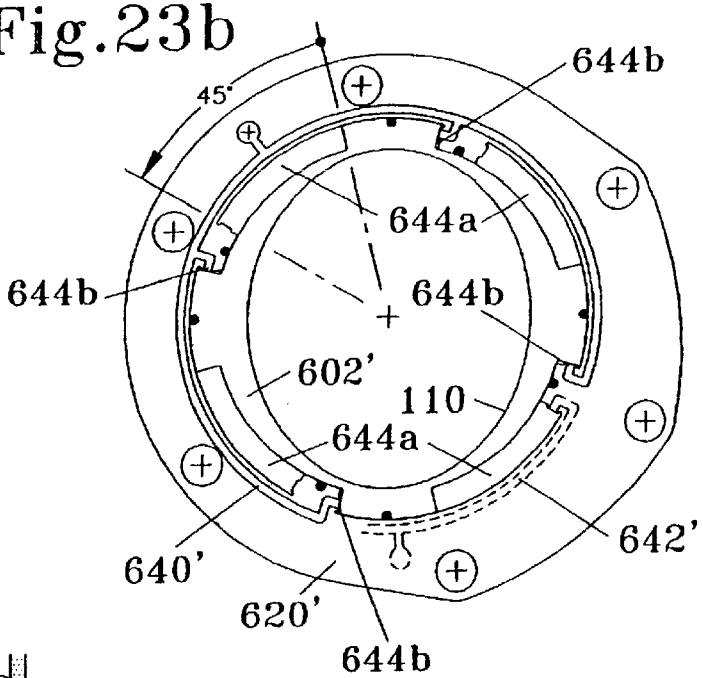
FIGS. 23*a*–23*b* depict cam rings which are rotated using oil pressure.
Figure 23A:
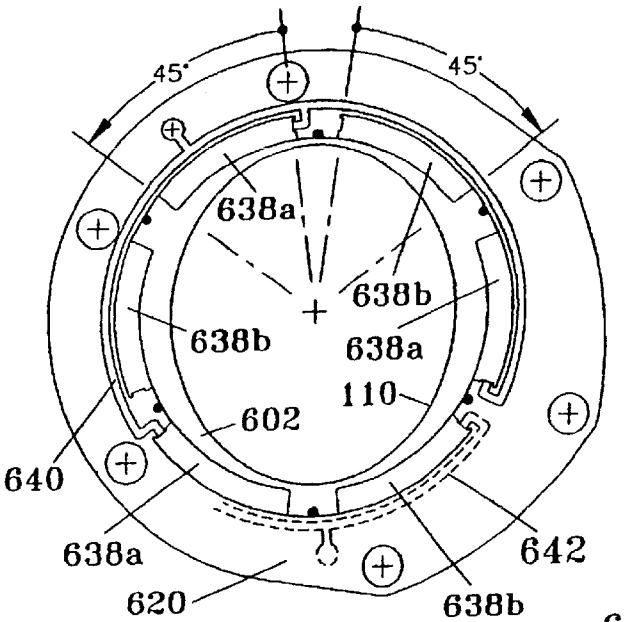
Figure 24:
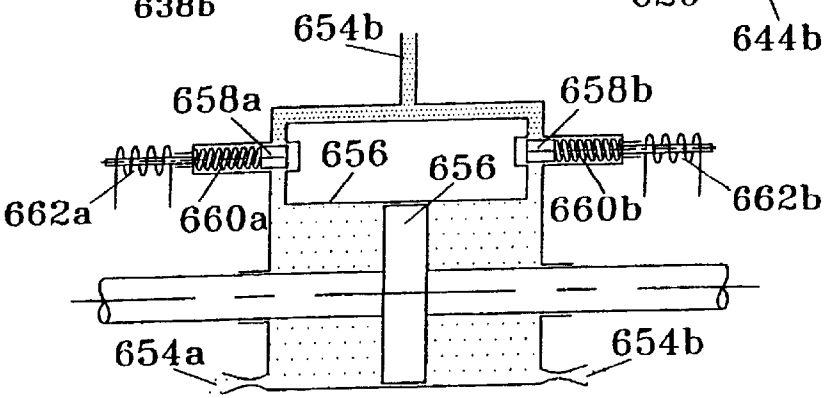
FIG. 24 depicts an actuator for use with the cam rings shown in FIG. 23.

Also, all of the actuators described thus far have been mechanically controlled. However, the invention is not so limited, but may instead include other actuator variations, such as hydraulically controlled actuators. For instance, FIG. 23*a* shows a body plate 620, and a cam ring 602 provided within the body plate 620 suitable for use in a hydrostatic transmission, a rotary pump, or a rotary motor. The cam ring 602 includes three fluid actuator pockets 638*a*, 638*b*, 638*c*, and the body plate 620 includes a first and second oil passages 640, 642, which when fed with pressurized fluid, direct the fluid into the fluid actuator pockets 638, causing the cam ring 602 to rotate between −45° and +45°. Similarly, FIG. 23*b* shows a body plate 620', and a cam ring 602' provided within the body plate 620'. The cam ring 602' includes four fluid actuator pockets 644*a*, 644*b*, 644*c*, 644*d*, and the body plate 620' includes a first and second oil passages 640', 642' which, when fed with pressurized fluid, inject the fluid into the fluid actuator pockets 644, causing the cam ring 602' to rotate between 0° and +45°. FIG. 24 shows an electrically-controlled hydraulic actuator which is suitable for rotating each of the cam rings 602, 602' shown in FIG. 23.

The actuator shown in FIG. 24 comprises a cylinder 650 including a fluid inlet 652, a pair of fluid outlets 654*a*, 654*b*, coupled to the oil passages 640, 642, a piston 656 disposed within the cylinder 650, first and second needles 658*a*, 658*b* provided within opposite end faces of the cylinder 650, a first spring 660*a* coupled to the first needle 658*a*for withdrawing the first needle 658*a* from the cylinder 650, a second spring 660*b* coupled to the second needle 658*b* for withdrawing the second needle 658*b* from the cylinder 650, and electromagnetic coils 662*a*, 662*b* coupled respectively to the first and second needles 658*a*, 658*b* for opposing the springs 660*a*, 660*b*.

In operation, when the frequency of the coils 662 are maximized, the needles 658 restrict the flow of hydraulic fluid from the fluid inlet 652 through the fluid outlets 654, and the force exerted on the cam ring 602 by the actuator is zero. Without a balancing force to oppose the reactive forces exerted on the cam ring 602 by the rotor, the cam ring will assume the position shown in FIG. 4*g*. On the other hand, as the frequency of one of the coils 662 is reduced, the corresponding needle 658 is withdrawn from the cylinder 650, thereby increasing the flow of hydraulic fluid from the respective fluid outlet 654. Consequently, the force exerted on the cam ring 602 increases, causing the cam ring 602 to assume the position shown in FIG. 4*a*. If the frequency of the other of the coils 662 is reduced, the corresponding needle 658 is withdrawn from the cylinder 650, causing the cam ring 602 to assume the position shown in FIG. 4*m*.

FIG. 25 depicts a constant speed hydrostatic transmission 700 which is again substantially similar to the hydrostatic transmission 400, except that the input shaft 108 of the first hydraulic device 300*a* (pump) is modified for coupling to a primer mover such as an internal combustion engine, the output shaft 108' of the second hydraulic device 300*b* (motor) is coupled to an accessory drive pulley 750, and the first hydraulic device 300*a* includes fluid actuator pockets c1, c2 similar in function to the fluid actuator pockets of the case plate 620 shown in FIG. 23. The actuator pockets c1, c2 communicate with the pressure ports of the first hydraulic device 300*a* respectively through ports p2, p2' and serve to rotate the cam ring 102*a* in a direction responsive to changes in rotational speed of the input shaft 108.

Figure 25A:
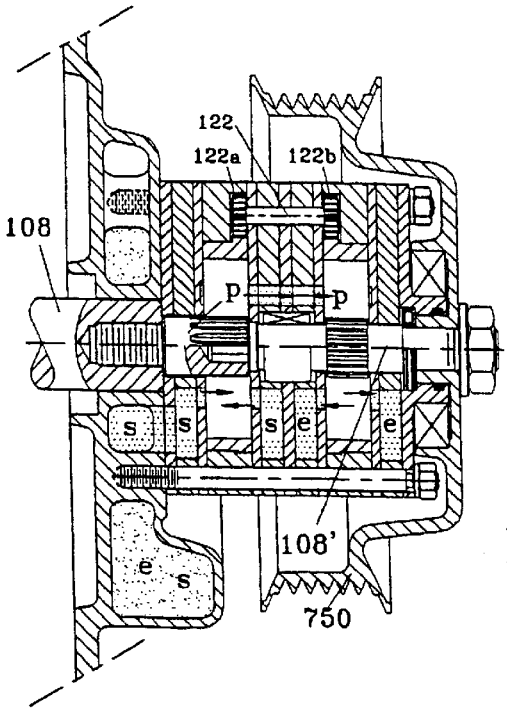
FIGS. 25*a*–25*d* depict a constant speed hydrostatic transmission incorporating the hydraulic device shown in FIG. 19.
Figure 25C:
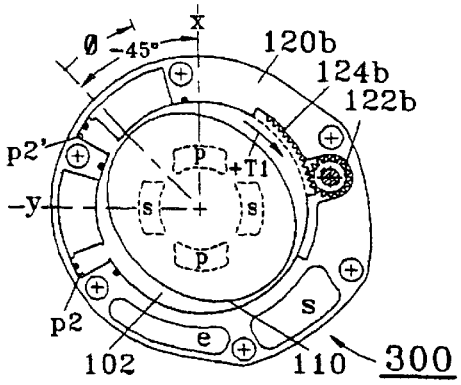
Figure 25B:
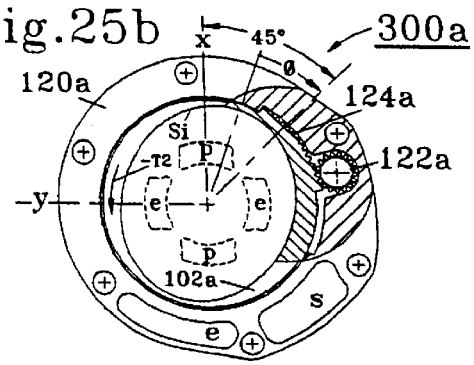
Figure 25D:
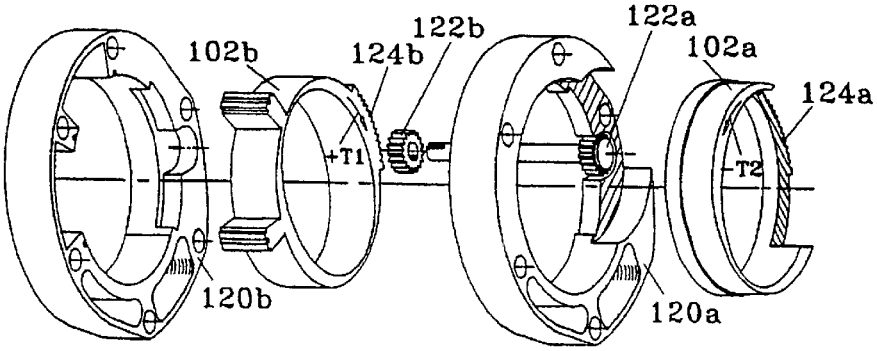

The first hydraulic device 300*a* is also provided with an actuator similar to the rotary actuator described above with reference to FIG. 3*a*, comprising a body plate 120*a* enclosing a cam ring 102*a*, a pinion 122*a* rotatably coupled to the body plate 120*a*, and a splined sector 124*a* disposed over the outer radial surface of the cam ring 102*a* for engaging the pinion 122*a*. Similarly, the second hydraulic device 300*b* is provided with an actuator comprising a body plate 120*b* enclosing a cam ring 102*b*, a pinion 122*b* rotatably coupled to the body plate 120*b*, and a splined sector 124*b* disposed over the outer radial surface of the cam ring 102*b* for engaging the pinion 122*b*. However, unlike the rotary actuator shown in FIG. 3*a*, the pinion 122*a* of the first hydraulic device 300*a* is coupled to the pinion 122*b* of the second hydraulic device 300*b* through a common shaft 752 so as to rotate the cam surface of the first hydraulic device 300*a* in unison with the cam surface of the second hydraulic device 300*b*. As shown in FIG. 25*b* and FIG. 25*c*, the cam rings of the first and second hydraulic devices 300*a*, 300*b* are misaligned, with the major axis of the cam surface of the first hydraulic device 300*a* being rotated −45° relative to the X-Y coordinate system passing through the suction and pressure ports, and the major axis of the cam surface of the second hydraulic device 300*b* being rotated +45° relative to the X-Y coordinate system, less an angle ∝.

Figure 26A:
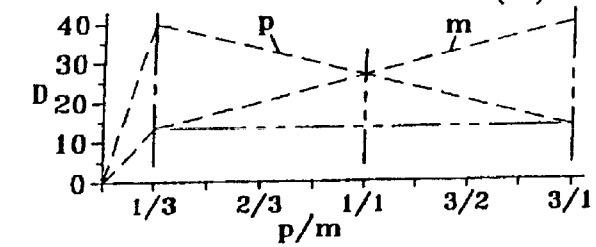
FIGS. 26*a*–26*c* are graphs of operating characteristics of the hydrostatic transmission shown in FIG. 25.
Figure 26B:
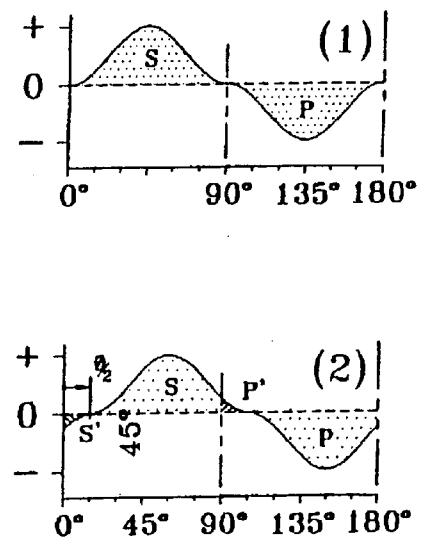

FIG. 26*a* depicts (1) the displacement D of the first and second hydraulic devices 300*a*, 300*b* as a function of the ratio m/p (motor/pump) of their respective speeds, (2) the reactive torques T1, T2 on their respective cam rings as a function of the angle ∝, and (3) the fluid pressure in the actuator pockets c1, c2 of the rotary actuator as a function of the angle–when the torque and output speed of the accessory drive pulley 750 remain constant and the ratio p/m changes from ⅓ to ⅗. FIG. 26*b* depicts the displacement of the first hydraulic device 300*a* when (1) the rotational speed of the output shaft 108' is three times that of the input shaft 108, (2) the rotational speed of the output shaft 108' is equal to that of the input shaft 108, and (3) the rotational speed of the output shaft 108' is one-third that of the input shaft 108. Similarly, FIG. 26*c* depicts the displacement of the second hydraulic device 300*b* when the (1) the rotational speed of the output shaft 108' is three times that of the input shaft 108, (2) the rotational speed of the output shaft 108' is equal to that of the input shaft 108, and (3) the rotational speed of the output shaft 108' is one-third that of the input shaft 108.

Figure 26C:
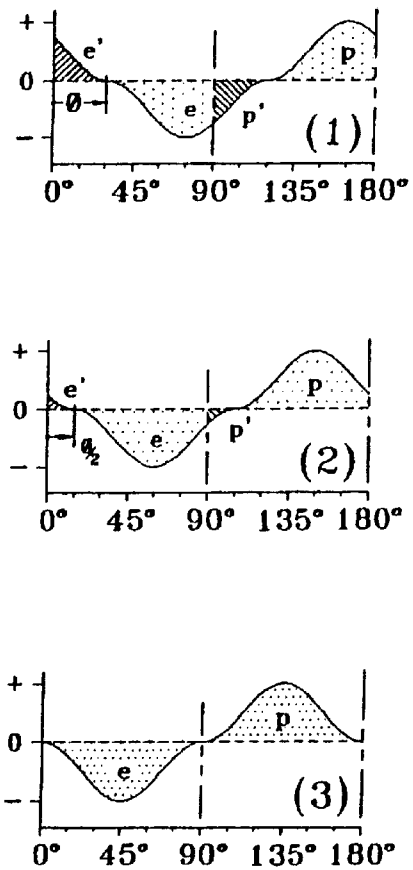

From FIGS. 26*a*, 26*b* and 26*c*, it will be apparent that if the engine speed decreases, the reduction in fluid pressure in the actuator pockets c1, c2 will cause the rotational angle of the cam surface of the first hydraulic device 300*a* to decrease (approach 0°) and the rotational angle of the cam surface of the second hydraulic device 300*b* to increase, causing the rotational speed of the output shaft 108' to remain constant. Similarly, if the engine speed increases, the increase in fluid pressure in the actuator pockets c1, c2 will cause the rotational angle of the cam surface of the first hydraulic device 300*a* to decrease (approach −45°) and the rotational angle of the cam surface of the second hydraulic device 300*b* to decrease, causing the rotational speed of the output shaft to again remain constant. Consequently, it will be appreciated that by misaligning the cam rings of the first and second hydraulic devices 300*a*, 300*b*, and by rotating the cam rings in unison in response to changes in rotational speed of the input shaft 108, the rotational speed of the output shaft 108' remains substantially constant, independent of the rotational speed of the input shaft 108.

Figure 27B:
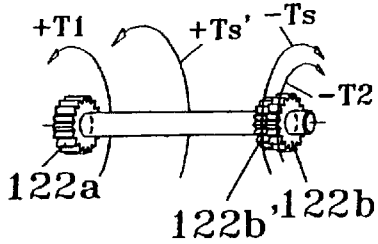
FIGS. 27*a*–27*b* depict a variation on the constant speed hydrostatic transmission shown in FIG. 25.
Figure 27C:
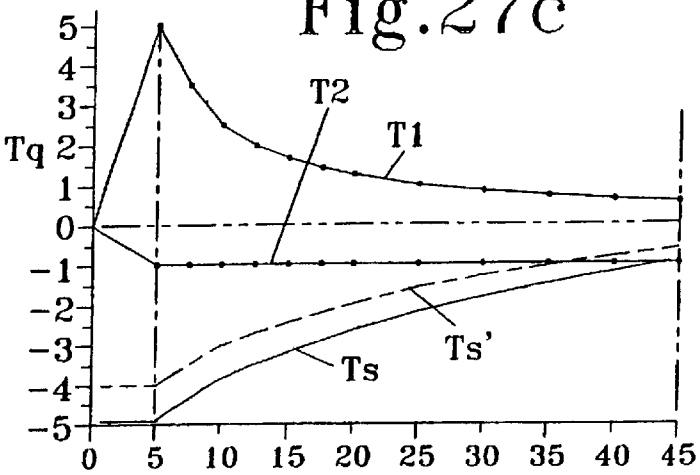
FIG. 27*c* is a graph of the operating characteristics of the hydrostatic transmission shown in FIG. 27.
Figure 27A:
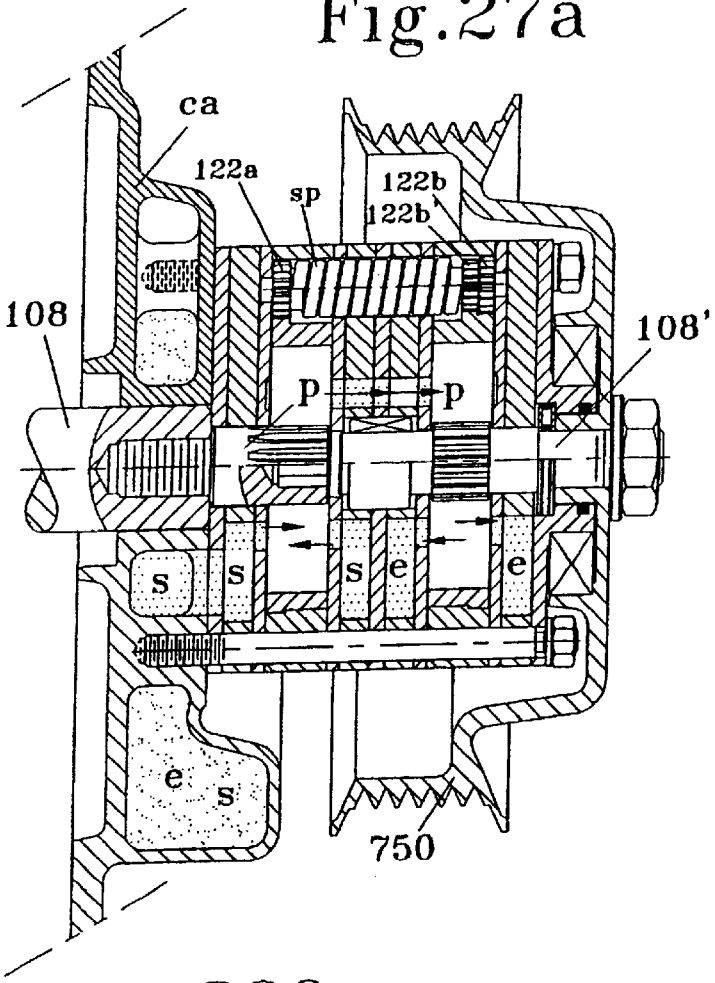

FIG. 27 depicts a hydrostatic transmission 800, which is substantially similar to the hydrostatic transmission 700, except that the pockets c1, c2 are deleted from the first hydraulic device 300*a*, and the second hydraulic device 300*b* includes a second splined sector 124*b'* having a greater pitch diameter than that of the splined sector 124. Also, the actuator includes a second pinion 122*b'* congruent with the second splined sector 124*b'* and freely mounted on the common shaft 752, and a torsion spring 754 provided between the pinion 120*a* and the second pinion 122*b'* to replace the pockets c1, c2. As will be apparent from FIGS. 27*b* and 27*c*, the torque characteristics of the hydrostatic transmission 800 are similar to the torque characteristics of the hydrostatic transmission 700, shown in FIG. 26*a*(2), except for the balancing torque Ts' which results when the torsional spring torque Ts is amplified by the revered gear-train loop comprising the second pinion 122*b'*, the second splined sector 124*b'*, the first splined sector 124*b*, and the pinion 122*b*. The balancing torque Ts' serves a similar function to the rotational torque induced on the cam ring 102*a* of the hydrostatic transmission 800 shown in FIG. 26. Consequently, when the engine is at idle, the balancing torque Ts' forces the cam ring profiles to a ratio p/m of ⅓, and as the engine speed increases above idle, the balancing torque Ts' urges the cam ring profiles of the hydraulic devices 300 to a ratio p/m of ⅗. When the engine is stopped, the balancing torque Ts' forces the cam ring profiles of the hydraulic devices 300 to a ratio p/m of ⅗.

Figure 28A:
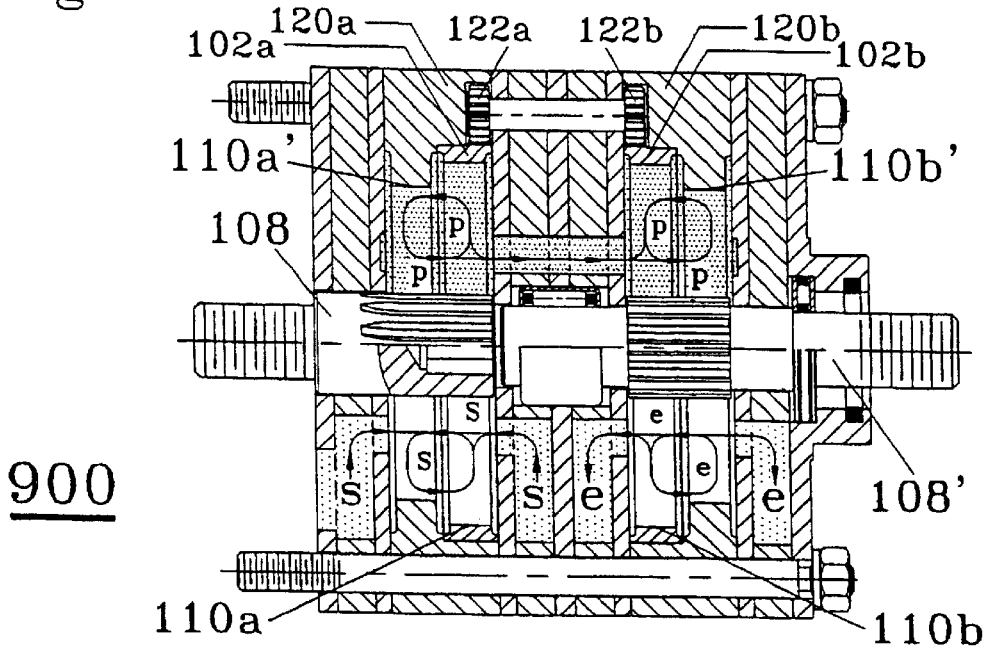
FIGS. 28*a*–28*b* depict a hydrostatic transmission incorporating two pairs of tandem-mounted rotors.
Figure 28B:
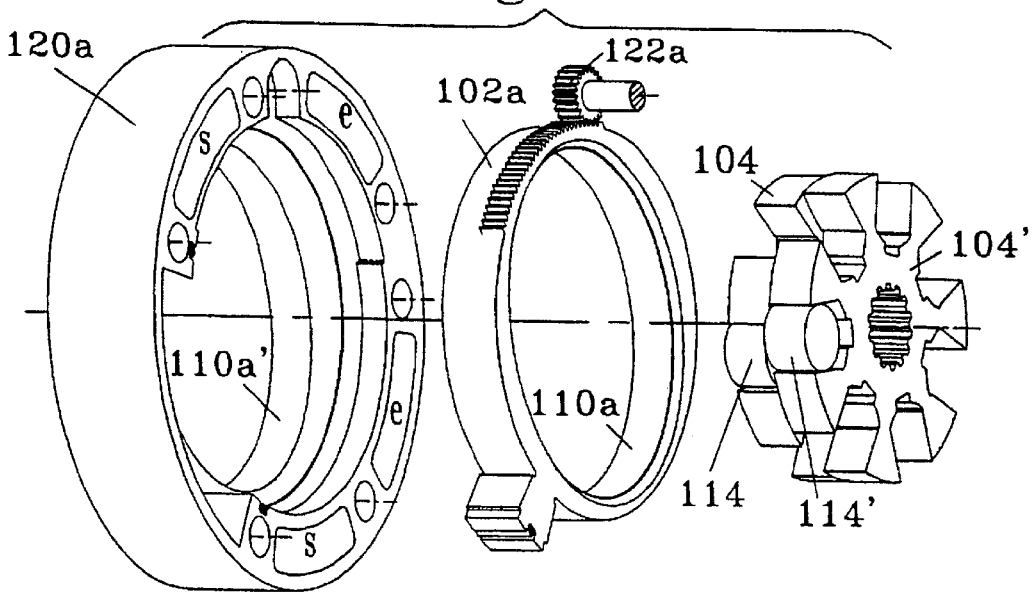

FIG. 28 depicts a hydrostatic transmission 900 which is also substantially similar to the hydrostatic transmission 700, except that the pockets c1, c2 are deleted from the first hydraulic device 300*a*, and each of the hydraulic devices 300 includes a compound rotor 902 comprising a first rotor half 104 and a second rotor half 104' mounted in tandem. As shown in FIG. 28*b*, preferably the first rotor half 104 is misaligned with the second rotor half 104' so as to reduce the possibility of loss of sealing between adjacent pump elements. Also, preferably each sealing element comprises the U-shaped shell 156 and a cylindrical core 158 sealing element described with reference to FIG. 18, with each sealing element extending the full axial extent of the respective compound fluid chamber, namely between the fluid chamber of the first rotor half 104 through to the corresponding fluid chamber of the second rotor half 104'. A benefit of the compound rotor 902 is that the panting, which results from variable displacement, occurs between the pump elements of the compound rotor 902, thereby producing little disturbance felt in the suction, pressure and exhaust galleries.

Figures 29A, 29B, 29C:
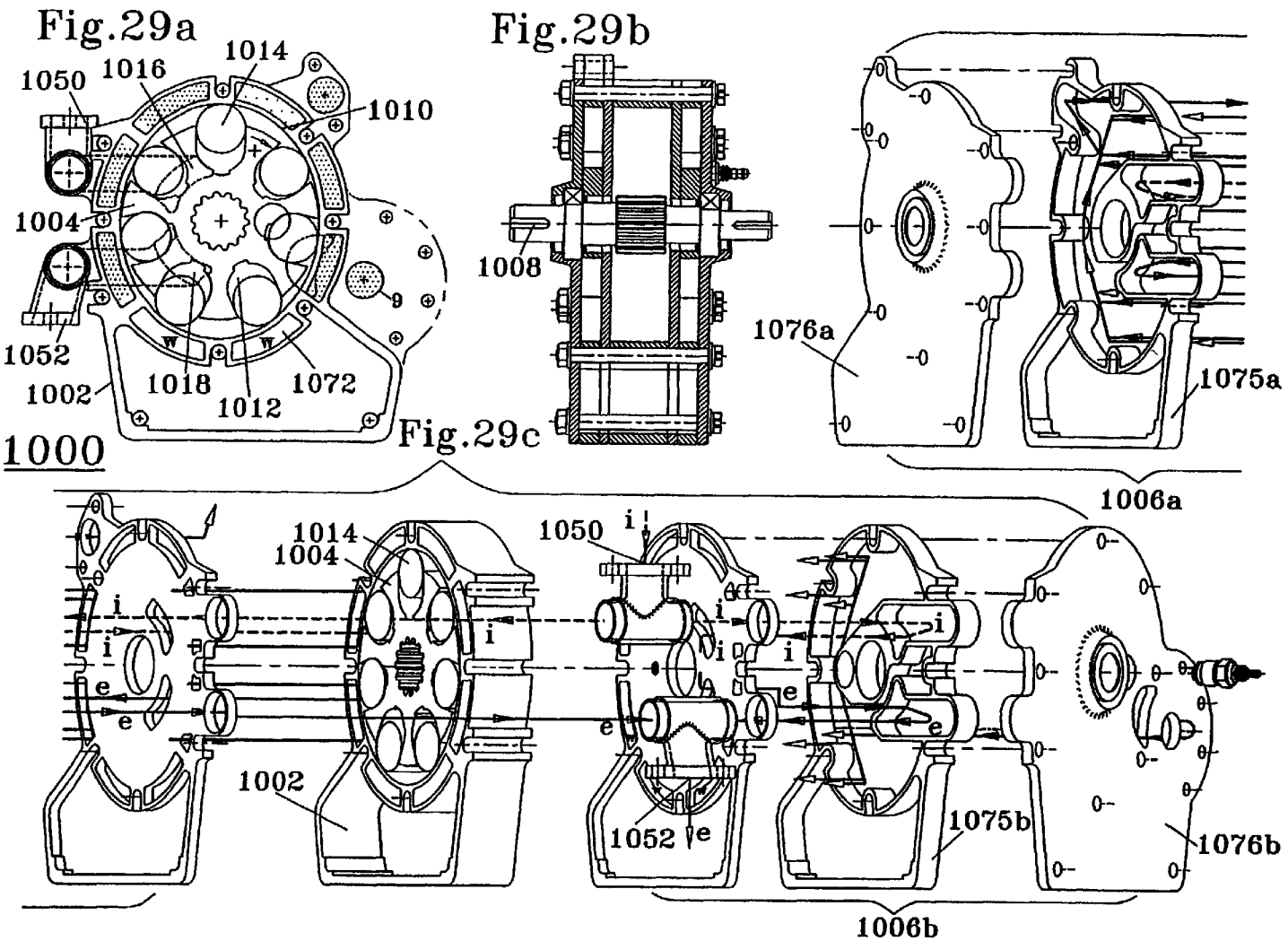
FIGS. 29*a*–29*c* depict an internal combustion engine incorporating the rotary pump structure according to the invention.

Turning now to FIG. 29, a four-stroke internal combustion engine 1000 is shown implementing the rotary pumps described herein. The internal combustion engine 1000 comprises a crankcase 1002, a rotor 1004 disposed within the crankcase 1002, left and right rotor end plates 1006*a*, 1006*b* enclosing the rotor 1004, a rotatable shaft 1008 coupled to the rotor 1004, spacer plates 1075*a*, 1075*b* for water chambers, and engine end plates 1076*a*, 1076*b*

The crankcase 1002 includes a two-stroke cam surface 1010 having a centre of symmetry coinciding with the axis of rotation of the rotor 1004, a sparkplug port (not shown) opening into the interior of the crankcase for receiving a spark plug 1070, and a plurality of waterjackets 1072 for cooling.

The rotor 1004 includes a plurality of combustion chambers provided around the circumference of the rotor 1004. Each combustion chamber comprises an aperture 1012 opening into the circumference of the rotor 1004, and a piston element 1014 sealingly disposed within each aperture 1012. Each aperture 1012 has a substantially U-shape, with the width of the aperture 1012 being slightly greater than the width of each piston clement 1014 so as to allow each piston element 1014 to move within the respective aperture 1012 between a maximum compression position adjacent the radial innermost portion of the aperture 1012 and a minimum compression position adjacent the radial outermost portion of the aperture 1012 as the rotor 1004 rotates. Each rotor end plate 1006 includes an arcuately-shaped inlet port 1016 and a radially-adjacent arcuately-shaped exhaust port 1018. Each of the ports 1016, 1018 has an inner radius which coincides with the radial innermost portion of the apertures 1012, and an outer radius which overlaps with the inner radial surface of those piston elements 1014 oriented and their fully seated position. One of the rotor end plates 1006 also includes an intake manifold 1050 communicating with the inlet port 1016, and an exhaust manifold 1052 communicating with the exhaust port 1018.

As the rotor rotates, each piston element 1014 will be in the maximum compression position as the corresponding combustion chamber approaches the intake port 1016. As the combustion chamber is exposed to the intake port 1016, the piston element 1014 moves towards the minimum compression position, causing a fuel mixture to be drawn into the combustion chamber through the intake manifold 1050. The piston element 1014 then returns to the maximum compression position, thereby compressing the fuel mixture therein, whereupon the compressed gas mixture is ignited by the sparkplug. The piston element 1014 is then driven to the minimum compression position from by the force of the ignition. As the combustion chamber approaches the exhaust port 1018, the piston element 1014 returns to the maximum compression position, thereby driving out the ignited gas mixture through the exhaust manifold 1052. As will be appreciated, the internal combustion engine 1000 may be modified for a greater or lesser number of strokes by varying the cam profile and the number of ports, as described above.

Figure 31B:
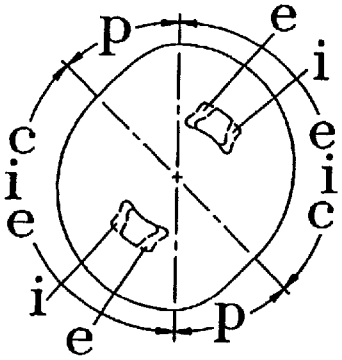
FIGS. 30*a*–30*b*, and 31*a*–31*b* depict variations on the internal combustion engine shown in FIG. 29.
Figure 31A:
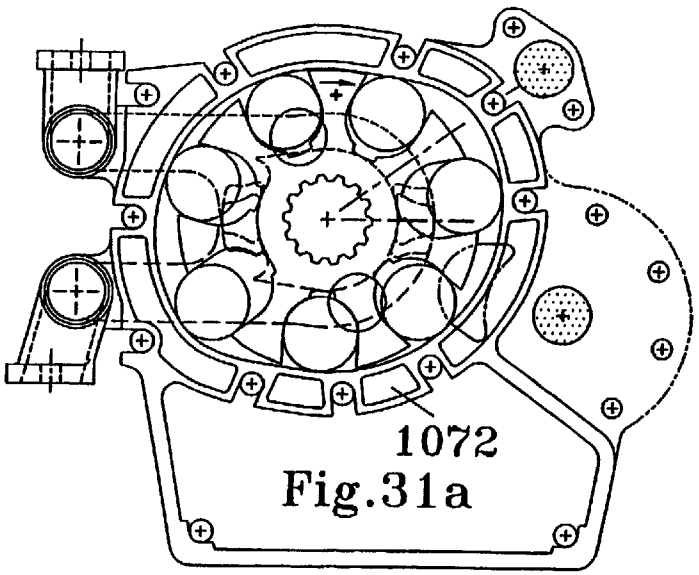
Figure 30B:
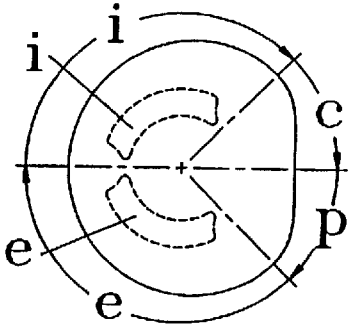
Figure 30A:
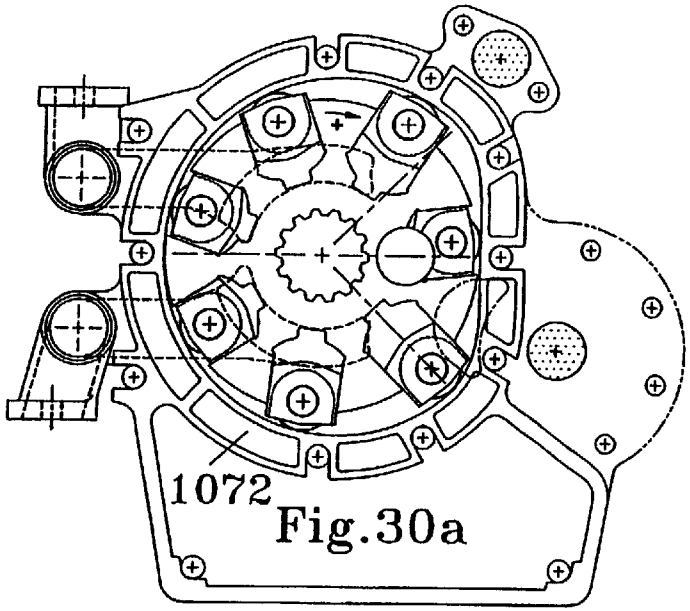

FIG. 30*a* depicts a four-stroke internal combustion engine, similar to the four-stroke internal combustion engine 1000, except that the cam surface comprises a two-stroke asymmetric cam surface in which the intake cycle (i), compression cycle (c), power cycle (p) and exhaust cycle (p) occur as shown in FIG. 30*b*. FIG. 31 a depicts another four-stroke internal combustion engine, similar to the four-stroke internal combustion engine 1000, except that the cam surface comprises a two-stroke asymmetric cam surface in which the intake cycle (i), compression cycle (c), power cycle (p) and exhaust cycle (p) occur as shown in FIG. 31*b*.

Figure 32:
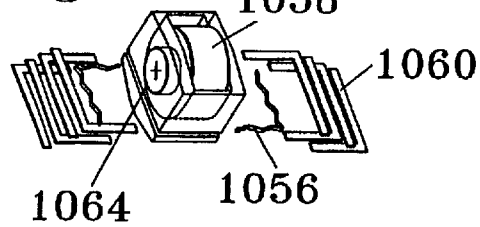
FIG. 32 depicts a piston element suitable for use with the internal combustion engines shown in FIGS. 29 and 30.

FIG. 32 depicts a piston element 1014 suitable for use in any of the foregoing internal combustion engines. The piston element 1014 is similar to the pump element shown in FIG. 18, comprising a U-shaped shell 1056, a cylindrical core 1058 provided within the shell 1056. The shell 1056 includes a pair of closed opposite ends 1060, and a bearing hole 1062 provided within each opposite end 1060. The core 1058 includes an axially-extending mandrel 1064 provided at each opposite end of the core 1058 for insertion into the bearing holes 1062 and thereby rotatably securing the core 1058 to the shell 1056. However, unlike the pump element shown in FIG. 18, the piston element 1014 also includes a plurality of overlapping L-shaped strips 1060 secured to the shell 1056, and backing L-shaped wave springs disposed between the strips which together act as a piston seal in the same way that piston rings seal a piston in a standard internal combustion engine.

The foregoing description is intended to be illustrative of the preferred embodiments of the invention. Those of ordinary skill will envisage certain additions, deletions or modifications to the described embodiments but which do not depart from the spirit or scope of the invention, as defined by the appended claims.

I claim:

1. A rotary pump comprising:

a cam ring including an asymmetric cam surface comprising a plurality of cam lobes;

a rotor disposed within the cam ring and including a centre of rotation and a plurality of fluid chambers, each said fluid chamber comprising an aperture opening into a circumference of the rotor, and a roller pump element sealingly disposed within the aperture, the rotor being configured such that each said pump element is disposed in constant contact with the cam surface and is moveable between a first position adjacent a radial innermost portion of the respective aperture and a second position adjacent a radial outermost portion of the respective aperture as the rotor rotates about the centre of rotation; and a pump body enclosing the cam ring and the rotor, and including a fluid inlet and a fluid outlet aligned only with the innermost portion of the fluid chambers respectively for transferring fluid to and fluid from the innermost portion of the fluid chambers, wherein, each said fluid chamber has a fluid ingress period of fluid flow between the fluid inlet and the fluid chamber, and a fluid egress period of fluid flow between the fluid chamber and the fluid outlet, and the cam surface is shaped to provide a fluid ingress period which is greater than the fluid egress period, the fluid inlet port and the fluid outlet port each have an angular length, and the inlet port angular length is greater than the outlet port angular length, the ports each comprise a radially outer edge portion, a radially inner edge, and a pair of opposing ends extending to the edges and conforming to a shape of the radially innermost aperture portion, and the cam ring includes a sprocket sector, and the pump includes a chain trained over the sprocket sector for rotating the cam ring about the centre of rotation to vary a flow rate of the pump.

2. The rotary pump according to claim 1, wherein the pump includes a cable disposed around the cam ring for rotating the cam ring about the centre of rotation to vary a flow rate of the pump.

3. The rotary pump according to claim 2, wherein the cam surface comprises a three-lobed epicycloidal cam surface, and the number of fluid inlets and the number of fluid outlets is three.

4. The rotary pump according to claim 3, wherein at least one of the pump elements comprises a tubular shell, a core provided within the tubular shell and including a pair of opposite ends, and a seal provided at each said opposite end.

5. The rotary pump according to claim 3, wherein at least one of the pump elements comprises a U-shaped shell, a spool-shaped core provided within the shell, the core including a pair of disc-shaped ends for tracking the cam surface and a shaft extending between the disc-shaped ends, and a plurality of roller elements disposed between the shell and the shaft.

6. The rotary pump according to claim 3, wherein at least one of the pump elements comprises a U-shaped shell including a pair of closed-opposite shell ends each incorporating a bearing hole therein, a plurality of roller elements disposed within the bearing holes, and a cylindrical core provided within the shell, the core including a pair of opposite core ends and a mandrel provided at each core end for rotatably securing the core to the shell.

7. A rotary pump comprising:

a centre reference shaft (108);

a cam ring (102) including an inner cam surface (110) with a plurality of cam lobes (R1) defined by a sector of said cam surface with a quadrant of increasing radius followed by an equal quadrant of decreasing radii, with a centre of symmetry coincident with an apex of said lobes;

a rotor (104) affixed to said centre shaft disposed within said cam ring incorporating a plurality of fluid chambers (112), each said fluid chamber comprising an inner semicircular dome and an aperture opening into a circumference of said rotor;

a disc (114) sealingly disposed within said aperture in contact with said cam surface such that as said rotor revolves said disc moves radially over a stroke length between a radial innermost position adjacent to said aperture dome and a second position adjacent to a radial outermost portion with said disc in contact with and centered on an apex of said lobe;

an outer pump body with attached association with said cam ring and incorporating a pattern of peripheral bolt holes; and two enclosing end plates (106*a* and 106*b*) incorporating a like pattern of peripheral bolt holes and pairs of ports thereon (116*a* and 118*a*) with respective locations of said pairs radially disposed on a centre radius of respective quadrants of said plurality of cam lobes, with inner and outer edges of said ports defined by circular sectors with centres coincident with said centre reference shaft, and end radial edges thereof defined by concave radial sectors with near coincidence with an inner semicircular dome of said fluid chambers (112) so that when said rotor rotates within a bolted assembly of said components, said fluid chambers thereof, when traversed over sectors of increasing and decreasing radii of said cam lobes, inwardly disposed fluid entrapment cavities defined by said discs, said inner semicircular domes, and said side plates, cause fluid to ingress and egress through said so disposed ports, with said entrapment cavities fully isolated from said disc and cam surface contact.

8. A rotary pump according to claim 7, wherein said body with attached association, is a separate outer body (120) with free inner circular contact with a circular outer surface of said ring cam (102), said circular cam surface provided with a gear sector (124), and said inner body surface provided with an off-set non-interference cavity to accommodate relative rotation of said gear sector and ring cam; and a spindle and pinion (122) in mesh with said gear sector, is held to and extends through a said side plate providing a means to change a radial relationship between said cam lobes and said pairs of fluid ports.

9. A rotary pump according to claim 7, wherein said body with attached association is a separate outer body (620) with a plurality of circular sector cavities separated by inward radial extensions, a ring cam (602) with a plurality of circular sector cavities (638*a* and 638*b*) separated by outward radial extensions, with said ring cam and body sectors forming respectively a rotor and a stator of a rotary actuator and providing a means to change a radial relationship between said cam lobes and said pairs of fluid ports.

10. A rotary pump according to claim 9, wherein said cam rings incorporate asymnmetrical lobes, so that rotational periods of ingress are of greater duration than those of egress.

* * * * *